US006097408A

United States Patent [19]

Fukushima et al.

[11] Patent Number: 6,097,408

[45] Date of Patent: Aug. 1, 2000

[54] INK JET RECORDING APPARATUS

[75] Inventors: Hisashi Fukushima; Jiro Moriyama; Takashi Uchida; Haruhiko Moriguchi, all of Yokohama; Yasushi Miura, Kawasaki; Masami Izumizaki, Yokohama, all of Japan

[73] Assignee: Canon Kabushiki Kaisha, Tokyo, Japan

[21] Appl. No.: 09/065,526

[22] Filed: Apr. 24, 1998

Related U.S. Application Data

[62] Division of application No. 07/752,279, Aug. 28, 1991.

[30] Foreign Application Priority Data

| | | | |
|---|---|---|---|
| Aug. 31, 1990 | [JP] | Japan | 2-227928 |
| Aug. 31, 1990 | [JP] | Japan | 2-227929 |
| Aug. 31, 1990 | [JP] | Japan | 2-227932 |
| Aug. 21, 1991 | [JP] | Japan | 3-208396 |

[51] Int. Cl.[7] ..... B41J 2/165

[52] U.S. Cl. ..... 347/34; 347/55

[58] Field of Search ..... 347/104, 16, 55, 347/34

[56] References Cited

U.S. PATENT DOCUMENTS

| | | | |
|---|---|---|---|
| 4,183,030 | 1/1980 | Kaieda et al. . | |
| 4,313,124 | 1/1982 | Hara . | |
| 4,345,262 | 8/1982 | Shirato et al. . | |
| 4,364,054 | 12/1982 | Kelly . | |
| 4,442,439 | 4/1984 | Mizuno . | |
| 4,459,600 | 7/1984 | Sato et al. . | |
| 4,463,359 | 7/1984 | Ayata et al. . | |
| 4,477,869 | 10/1984 | Rudd, III . | |
| 4,558,333 | 12/1985 | Sugitani et al. . | |
| 4,737,803 | 4/1988 | Fujimura et al. . | |
| 5,049,899 | 9/1991 | Dunand et al. . | |
| 5,136,307 | 8/1992 | Uchida et al. . | |
| 5,270,738 | 12/1993 | Takashi et al. . | |
| 5,477,249 | 12/1995 | Hotomi | 347/55 X |

FOREIGN PATENT DOCUMENTS

| | | |
|---|---|---|
| 0241118 | 10/1987 | European Pat. Off. . |
| 0376309 | 7/1990 | European Pat. Off. . |
| 3042068 | 5/1981 | Germany . |
| 55-086762 | 6/1980 | Japan . |
| 56-051369 | 5/1981 | Japan . |
| 57-063287 | 4/1982 | Japan . |
| 58-151257 | 9/1983 | Japan . |
| 60-046257 | 3/1985 | Japan . |
| 62-147473 | 7/1987 | Japan . |
| 62-151348 | 7/1987 | Japan . |
| 62-225353 | 10/1987 | Japan . |
| 62-271752 | 11/1987 | Japan . |

*Primary Examiner*—N. Le
*Assistant Examiner*—Shih-wen Hsieh
*Attorney, Agent, or Firm*—Fitzpatrick, Cella, Harper & Scinto

[57] ABSTRACT

An ink jet recording apparatus performing recording by discharging ink onto a recording medium is provided with a conveying belt for conveying the recording medium by the attraction of static electricity, an electrode provided to be in contact with the recording medium conveyed by the conveying belt, and a power source capable of charging the electrode with the charge which has the polarity opposite to the charge carried by the conveying belt. The main droplet and satellite split from the ink droplet are impacted on the recording medium to prevent the adhesion of the satellite to the discharging port of the discharging surface of the recording head, thus maintaining desirable recording for a long time.

7 Claims, 17 Drawing Sheets

RECORDING SIGNALS
(V)
30
0
20μs

VOLTAGE V1 OF CHARGER ROLLER 4
(V)
1500
0

VOLTAGE V2 OF CHARGER ROLLER 4
(V)
1500
0
0
100
150
200
300
400
500(μs)
TIME 57
31
60
30
GND
0.5mm
+800V
50

57
31
61
30
GND
+800V
50

57
31
63-1
63-2
63-2
62
30
GND
+800V
50

57
31
63-2
62
30
63-2
GND
+800V
50

INK JET RECORDING APPARATUS

This application is a Division of Ser. No. 07/752,279 Aug. 28, 1991.

BACKGROUND OF THE INVENTION

1. Field of the Invention

The present invention relates to an ink jet recording apparatus for performing the recording by discharging ink onto a recording medium.

2. Related Background Art

Traditionally, there has been known an ink jet recording apparatus for performing the recording by discharging ink droplets onto a recording medium (in most cases, paper, or OHP sheet, cloth, and the like) from a discharging port. The ink jet recording apparatus is a non-impact type recording apparatus capable of performing recording with less noise directly on an ordinary paper as well as the recording of a color image with ease using multicolor. With these features, the widespread use of ink jet recording apparatus has increased rapidly in recent years. Particularly, an ink jet recording apparatus of a type that ink droplets are discharged by an action caused by a phase change generated by the thermal energy given to ink on the basis of recording signals is simple in its structure and has an advantage that a high-precision multinozzle is easily configured to implement a high-resolution and high-speed recording.

However, these ink jet recording apparatuses discharge ink droplets directly from fine discharging ports provided on a surface (discharging surface) of the recording head facing a recording medium. Accordingly, in order to perform a desirable recording, appropriate care should be taken. For example, there is a need for the maintenance of a constant distance between the recording head and recording medium as well as the accurate control of the conveyance of the recording medium. To this end, the recording medium may be electrostatically attracted to a belt or the like which functions as a means for conveying the recording medium. For such a method of conveying the recording medium, there is known a method such as disclosed in Japanese Patent Laid-Open Application No. 62-147473 wherein a belt is charged in advance, and the recording medium is allowed to touch this belt to be attracted thereto by the attraction generated by dielectric polarization, and others.

Furthermore, examples of using static electricity dually as a source to generate energy for discharging ink are disclosed in Japanese Patent Laid-Open Application No. 60-46257, Japanese Patent Laid-Open Application No. 62-151348, and Japanese Patent Laid-Open Application No. 62-225353. In all of these examples, the electrode is arranged on the reverse side of the recording medium (the side at which no recording head is provided) to apply voltage between this electrode and the recording ink.

In the ink jet recording apparatus wherein the recording medium is attracted and held by static electricity according to the conventional art set forth above, an electric field is generated between the surfaces of the recording medium and recording head, and the flight of the ink droplets discharged from the recording head is disturbed. Thus a problem is encountered that the recording is not performed as desired in some cases.

More specifically, satellites (sub-droplets) produced when the ink droplet is split in flying may make a U-turn and so adhere to the vicinity of the discharging port of the discharging surface. The satellites tend to be charged with the same polarity as the recording medium, and it becomes easier for them to adhere to the vicinity of the discharging port of the discharging surface. In other words, the amount of the flying ink toward the recording medium becomes smaller in the case where no electric field mentioned above exists as shown in FIG. 13A, i.e., as compared with the case where no static electricity is used for attracting and holding the recording medium. Further, as shown in FIG. 13B, there is a case where the satellites (sub-droplets) produced due to the splitting of the ink droplet in flight are caused to adhere to the vicinity of the discharging port of the discharging surface because of the aforesaid electric field. If the satellites adhere to the vicinity of the discharging port of the discharging surface like this, the subsequent normal discharging is hindered, leading to the distorted ink flight or disabled ink discharging. If any aqueous ink is employed, it is possible to prevent the adhesion of the satellites to a certain extent by giving a water splashing treatment to the discharging surface, but using only with the water splashing treatment, no sufficient effect is obtainable.

Now, using the drawings, a specific description will be made.

In FIG. 14, the conventional example of the aforesaid ink jet recording apparatus is shown.

In this ink jet recording apparatus, a voltage of approximately +2 kv is applied from a power source 52 to a charging roller 54, and when the charging roller is in contact with a conveyer belt 51 which is means for conveying the recording medium 50, the aforesaid conveyer belt 51 is charged positively (+). When the recording medium 50 is fed onto the aforesaid charged conveyer belt 51 by a carrier roller 53, the aforesaid recording medium 50 is attracted and held by static electricity of the conveyer belt 51 to the conveyer belt 51 and carried in the direction indicated by arrow A. At this juncture, the recording medium 50 is grounded through a resilient electrode 56 provided to be in contact with the recording medium 50 which is being conveyed on the conveyer belt 51. Then, the recording medium 50 is more intensely attracted and held by the conveyer belt 51 to be carried to a position facing the four recording heads 57. Subsequently, ink, colored respectively black, yellow, magenta, and cyan, is discharged from each of the recording heads 57 (57Bk, 57*y*, 57*m*, and 57*c*) to perform the recording on the recording medium 50.

In the aforesaid conventional ink jet recording apparatus, a phase of approximately +800 v exists on the surface of the recording medium 50 according to an experiment. Therefore, as shown in FIGS. 15A through 15D respectively, the ink droplet discharged from each of the recording heads 57 (57Bk, 57*y*, 57*m*, and 57*c*) is polarized and split into the main droplet and satellites (sub-droplets) ultimately in some cases. Here, the satellites are in most cases charged with the same polarity as the recording medium 50 (FIG. 15C). Then, the positively charged satellite repels the recording medium 50 which is given positive charge, and tends to adhere easily to the vicinity of the discharging port 30 of the discharging surface 31 of each of the recording heads 57. Thus, if the satellite adheres to the aforesaid discharging surface 31, a normal discharging is hindered, and there is a possibility that ink cannot be discharged sometimes. Also, in general, the faster the conveying velocity of the recording medium is, the more the adhesion of the satellites become conspicuous, leading to the difficulty in making the recording faster.

Also, particularly, the aforesaid adhesion of the satellites is quite conspicuous in using the full-line head provided with a plurality of discharging ports over the entire width of the recording area as shown in FIG. 15 as described earlier or in color recording.

Subsequently, in this respect, the specific description will be made of the phenomena of the ink adhesion to the vicinity of the discharging port using FIGS. 15A through 15D.

FIG. 15A is a view illustrating the timing immediately before the formation of a discharged droplet. A charging roller 54 made of dielectric rubber to which a voltage of approximately +2 kv has been applied (by a high-voltage power source 52) is brought into contact with a conveyer belt 51 to charge the surface of the conveyer belt 51 with positive charge. Then, by placing the recording medium 50 closely onto the conveyer belt 51, negative charge is given to the side of the recording medium 50 facing the conveyer belt 51. Thus, the attraction of the recording medium 50 and conveyer belt 51 is generated. To the side of the recording medium 50 opposite to the conveyer belt 51 (the side facing the recording heads 57 (57Bk, 57*y*, 57*m*, and 57*c*)), positive charge is given, and a potential difference is generated between the recording heads 57 (57Bk, 57*y*, 57*m*, and 57*c*) and the recording medium 50 to form an electric field. Then, to the liquid column 60 formed by the bubble generated by the thermal driving of the electrothermal converter 40 in the recording head 57 (57Bk, 57*y*, 57*m*, and 57*c*), the negative charge opposite to the positive charge on the recording medium 50 is given, and the droplet 61 is polarized by the effect of the aforesaid electric field as shown in FIG. 15B which represents the phenomenon in the timing for the droplet 61 to fly in the air.

The phenomenon in the next timing is shown in FIG. 15C. As shown in FIG. 15C, the liquid column is split into the main droplet 62 and satellite 63-1 respectively charged negatively and the satellites 63-2 charged positively. Then as shown in FIG. 15D, the main droplet 62 having a large kinetic energy is impacted on the recording medium 50. However, the positively charged satellites repel the positively charged recording medium 50 to adhere to the vicinity of the discharging port 30 by returning in the direction toward the discharging surface 31 in a U-turn fashion as shown in FIG. 15D. This brings about the aforesaid problem.

SUMMARY OF THE INVENTION

An object of the present invention is to provide an ink jet recording apparatus capable of maintaining a desirable recording for a long time.

Another object of the present invention is to provide an ink jet recording apparatus capable of maintaining a high-quality recording for a long time.

Still another object of the present invention is to provide an ink jet recorder capable of reducing the frequency of blinding the ink discharging port by preventing the adhesion of the unwanted ink to the discharging port but to the recording medium and of shortening the time required for its maintenance.

A further object of the present invention is to provide an ink jet recording apparatus capable of performing a desirable recording without the adhesion of the satellites to the discharging surface even if static electricity is utilized for attracting and holding the recording medium.

Still a further object of the present invention is to provide an ink jet recording apparatus capable of performing a-desirable recording by preventing a defective ink discharging even if static electricity is utilized for attracting and holding the recording medium.

One of the specific objects of the present invention is to provide an ink jet recording apparatus provided with the recording head for discharging ink droplets toward a recording medium, a conveying means for attracting and holding the aforesaid recording medium by static electricity to convey the recording medium to a position facing the aforesaid recording head, an electrode slidably in contact with the aforesaid recording medium thus held, and a power source for injecting through the aforesaid electrode a charge having the polarity opposite to the charge given to the aforesaid conveying means.

BRIEF DESCRIPTION OF THE DRAWINGS

FIG. 13A illustrates the case where no electric field exists, and FIG. 13B, the case where an electric field exists;

DETAILED DESCRIPTION OF THE PREFERRED EMBODIMENTS

Subsequently, in reference to the accompanying drawings, each of the embodiments suited for the present invention will be described.

An embodiment set forth below is such that the charge on the recording medium which generates an electric field to cause the discharged ink droplet to be split is neutralized when a charge having the polarity opposite to the charge given to the conveying means is applied by the power source to the recording medium attracted and held by the aforesaid conveying means by the static electricity of the conveying means. Accordingly, this is an example in which the ink droplet is impacted on the recording medium without being split into the main droplet and satellites thereby to prevent the adhesion of the satellites to the discharging surface of the recording head.

Figure 1:
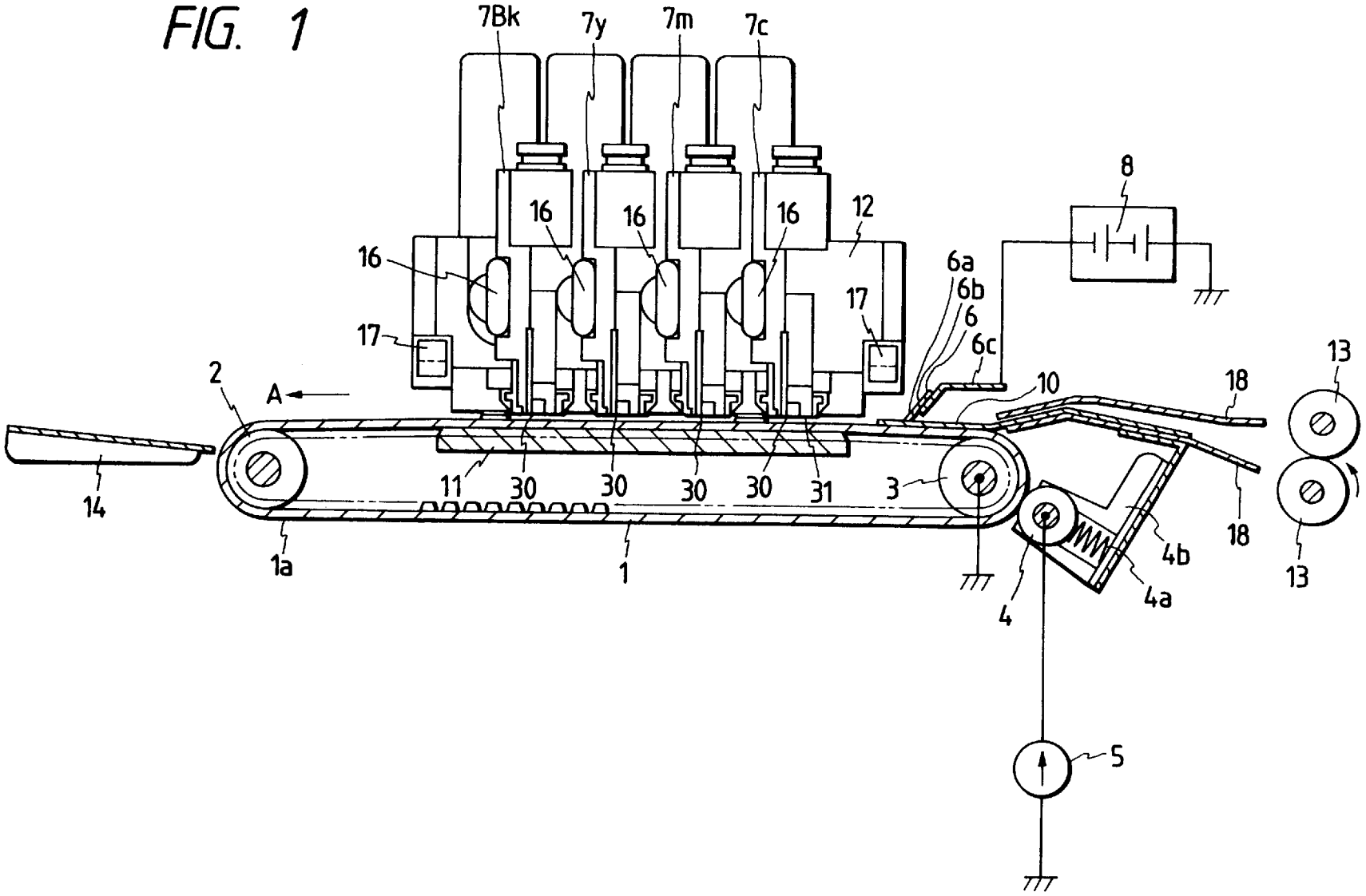
FIG. 1 is a cross-sectional side view schematically showing a first embodiment according to the present invention.

Now, FIG. 1 is a cross-sectional side view schematically showing the aforesaid embodiment of the ink jet recording apparatus according to the present invention.

Figure 4:
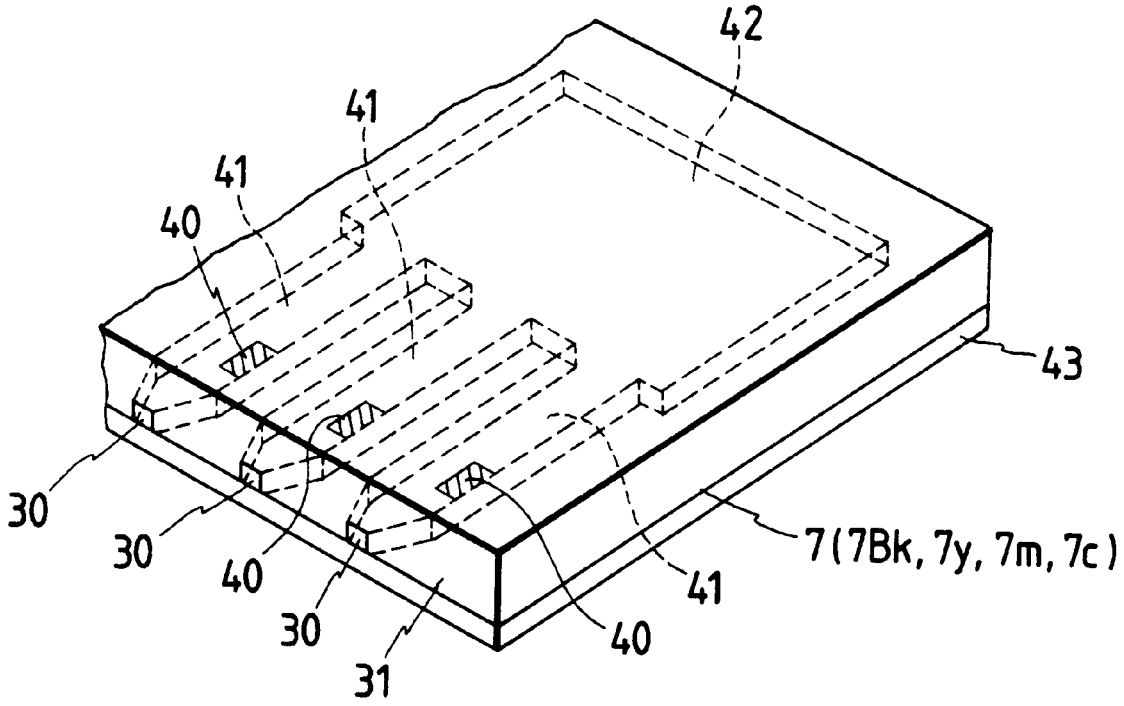
FIG. 4 is a perspective view showing an embodiment of the head used for the present invention.

The recording apparatus according to the present embodiment is a recording apparatus having the ink jet method of discharging ink by the utilization of thermal energy, which is capable of performing a multicolor recording by a full-multitype recording head. In the present embodiment, the four recording heads 7 (7Bk, 7*y*, 7*m*, and 7*c*) are collectively mounted in a head mounting frame 12 respectively for each ink of black, yellow, magenta and cyan inks, facing conveyer belt 1 which will be described later. Each of the recording heads 7 (7Bk, 7*y*, 7*m* and 7*c*) is formed with a head 7 shown in FIG. 4, and is a full-line type having discharging ports 30 arranged in parallel over the entire width of the recording area. As shown in FIG. 4, each recording head 7 is provided with electrothermal converters 40 incorporated in the respective discharging ports 30. When each of these electrothermal converters 40 is energized becomes exothermic, film boiling occurs to form a bubble in the ink liquid path (nozzle) 41. Then, by the growth of this bubble, the ink droplet is discharged from the discharging port 30. Each of the recording heads 7 is arranged to install many discharging ports 30 aligned in one line in the direction perpendicular to the plane of FIG. 4, i.e., perpendicular to the direction in which the recording medium is conveyed. In this example, 4,736 discharging ports 30 are provided in each of the recording heads 7 with a density of 400 dpi (400 pieces for a length of one inch). In this respect, a reference numeral 31 designates the discharging surface; 42, a common liquid chamber; and 43, a substrate.

Also, the endless conveyer belt 1, which is a conveying means for attracting and holding the recording medium such as a recording paper by static electricity, has an insulating layer of volume resistivity of $10^{14}$ Ωcm or more on its surface, and is rotatively supported by two rollers 2 and 3 in the direction indicated by arrow A in FIG. 1. Further, on the reverse side of the conveyer belt 1 at the position facing each of the recording heads 7 (7Bk, 7*y*, 7*m*, and 7*c*), a platen 11 is provided in order to hold the conveyer belt 1 at a flat level. With this arrangement, the space between the discharging ports 30 of the head 7 and the recording medium 10 can be maintained precisely to improve the recording quality. Also, the roller 3 on the supply side is grounded. Facing this roller 3 is a charging roller 4 which is urged into contact with the conveyer belt 1 by the resiliency of a spring 4*a*. The aforesaid charging roller 4 is a roller to charge the surface of the conveyer roller 1 and is made of dielectric rubber. To this charging roller 4, a voltage of approximately +2 kv is applied from a high-voltage power source 5 (30 μA). Further, the leading end of an electrode 6, formed with a dielectric brush 6*a* and resin sheet 6*b* mounted on a holder 6*c*, is slidably provided on the surface of the conveyer belt 1 at a position immediately after the conveyer belt passes around the roller 3. The aforesaid electrode 6 is slidably in contact with the aforesaid recording medium 10 at a position (on the right-hand side in FIG. 1) before the leading end of the recording medium 10, which is attracted to and held by the conveyer belt 1 to be conveyed in the direction indicated by arrow A, reaches the position facing the four recording heads 7. The trailing end of the electrode 6 is connected to the negative pole of a d.c. power source 8, the positive pole of which is grounded.

In this respect, the recording medium 10 is fed into contact with the conveyer belt 1 by a pair of resisting rollers 13 in synchronism therewith for the recording made by the discharge of ink from the recording heads 7 and is output onto a stocker 14.

Here, a reference numeral 16 designates heat pipes to prevent the thermal accumulation of the recording heads 7 as well as to implement the equalization of the temperature of the recording heads over the entire width of the recording area. Reference numeral a head mounting shaft; 18, a guide; and 4*b*, a holder.

Now, the description will be made of the operation of the present embodiment.

At first, when the charging roller 4 is caused to be in contact with the conveyer belt 1, the surface of the conveyer belt 1 is positively charged. Then, when the recording medium 10 is fed onto the aforesaid charged conveyer belt 1, the polarization is generated on the aforesaid recording medium 10. Thus, the recording medium 10 is attracted to the conveyer belt 1. Subsequently, the recording medium 10 is conveyed in the direction indicated by arrow A, and when the leading end of the electrode 6 is slidably in contact with the surface of the recording medium 10, a negative charge is injected from the d.c. power source 8 in the surface of the recording medium 10 through the electrode 6. Then, by this negative charge, the recording medium 10 is more intensely attracted to the conveyer belt 1 and at the same time, the electric field generated by the positively charged conveyer belt 1 is offset to a considerable extent.

According to an experiment, if a voltage of approximately −1 kv is applied from the d.c. power source 8 in a state where a voltage of approximately +2 kv is being applied from the power source 5 to the conveyer belt 1, it is possible to restrict the surface phase of the recording medium 10 to approximately +200v. In this state, even if the conveying velocity of the recording medium 10 is made extremely high, such as 13.3 cm/s, and a recording of approximately 40,000 sheets of A4 size is performed, no satellites adhere to the respective discharging surfaces 31 of the recording heads 7 to make a high quality recording possible continuously, and a desirable result is obtained. Also, even when satellite ink adheres to the recording medium 10, its quantity is extremely small and does not affect the recording quality.

Figure 2:
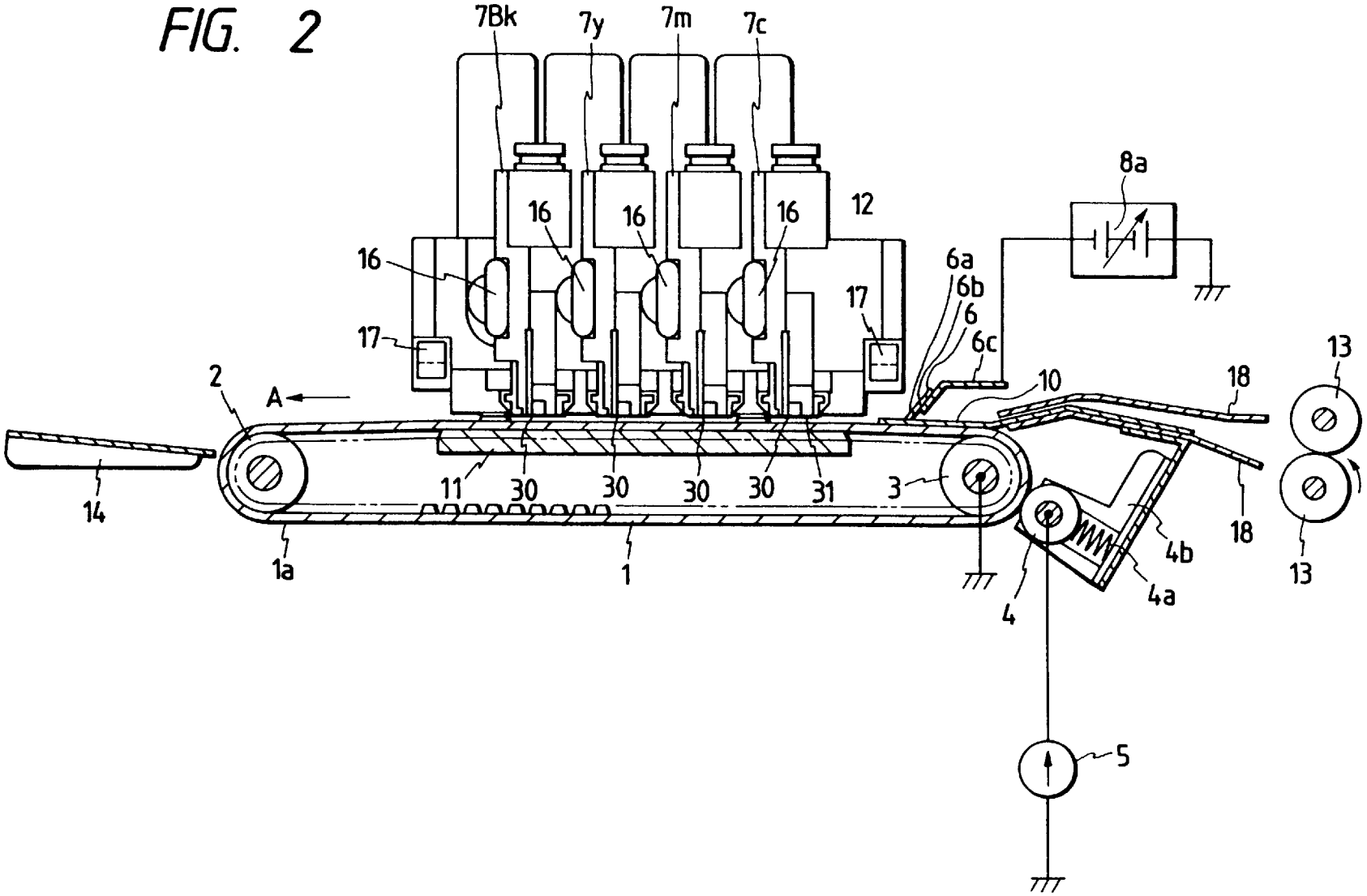
FIG. 2 is a cross-sectional side view schematically showing a second embodiment according to the present invention.

Next, a second embodiment of the present invention will be shown in FIG. 2.

The present embodiment is an embodiment wherein a variable d.c. power source 8*a* capable of varying the output voltage is provided in place of the d.c. power source 8 in the embodiment shown in FIG. 1. For example, in accordance with the kind of the recording medium 10, the conveying velocity, or the like, a voltage to be applied to the recording medium 10 can be defined. In this respect, the setting of this voltage may be performed automatically on the basis of signals from a control unit 100 which will be described later or may be arranged to be set by an operator manually. Therefore, with the present embodiment, it is possible to optimize the setting of the voltage in a better condition and to prevent the adhesion of the satellite to the discharging surface 31 reliably. Now, the constituents other than this are the same as those in the embodiment shown in FIG. 1, and the descriptions thereof will be cited.

In FIG. 3, a third embodiment of the present invention will be shown.

Figure 3A:
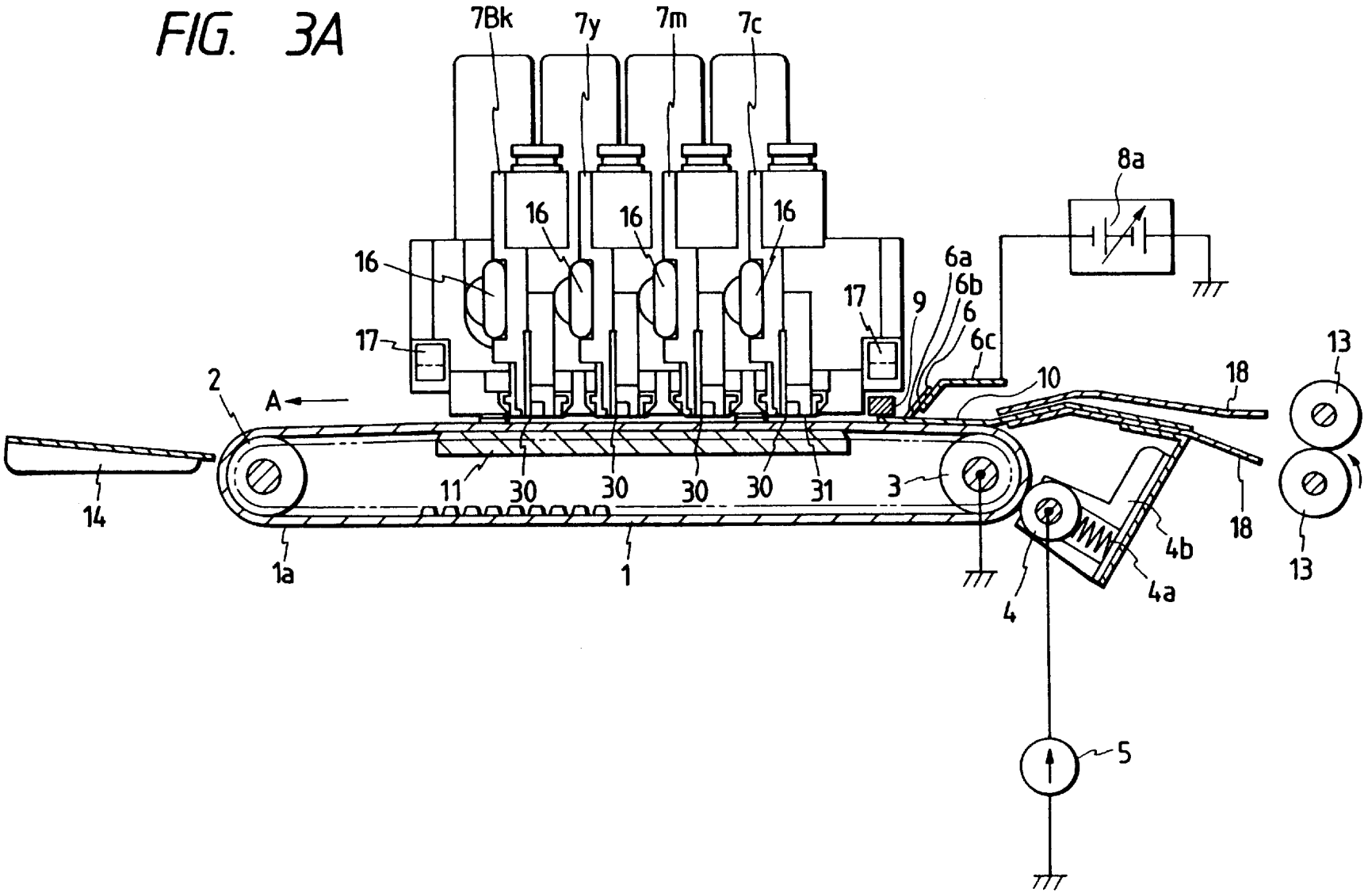
FIG. 3A is a cross-sectional side view schematically showing a third embodiment according to the present invention.
Figure 3B:
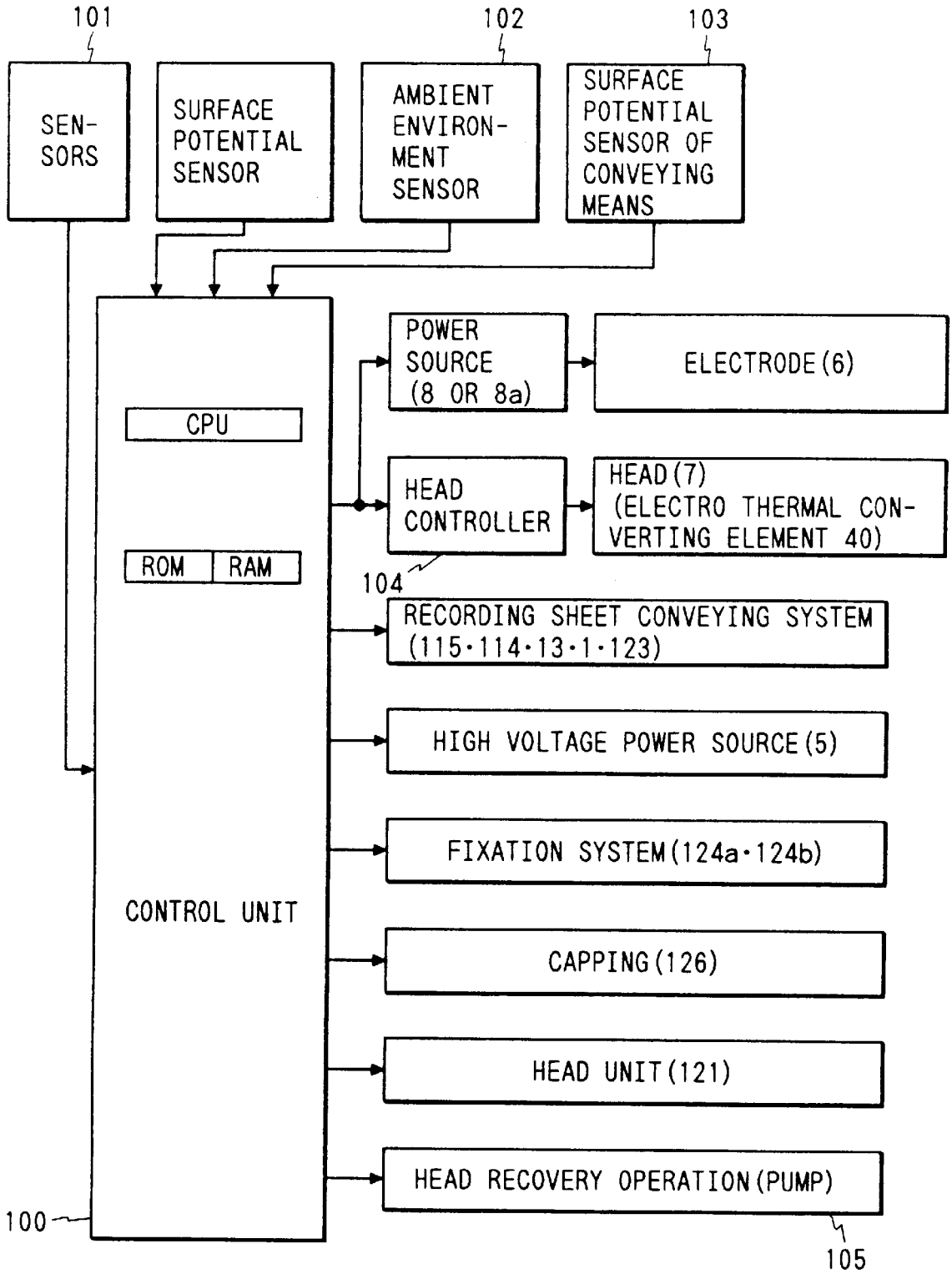
FIG. 3B is the block diagram thereof.

FIG. 3A is a cross-sectional view schematically showing the third embodiment according to the present invention; FIG. 3B, the block diagram thereof; and 3C, the flowchart thereof.

The present embodiment is an embodiment wherein a surface potential sensor 9 is provided in addition to the recording apparatus shown in FIG. 2 embodying the present invention to measure the surface potential of the recording medium 10 being conveyed by the conveying belt 1. This sensor 9 is a sensor to measure the surface potential of the recording medium 10 at a position in the upstream side of the recording position of the aforesaid recording heads 7 and in the downstream side of the electrode 6 (in the conveying direction of the recording medium 10). Thus, in accordance with the signals from the control unit 100 which will be described later in response to the surface potential measured by the aforesaid surface potential sensor 9, the voltage to be applied to the recording medium 10 can be set automatically. Therefore, the prevention of the satellite adhesion to the discharging surface 31 can be performed more reliably because the applied voltage is set on the basis of the surface potential of the recording medium 10. The other components of this embodiment are the same as those in the embodiment shown in FIG. 2, and the description thereof will, accordingly, be cited omitted.

In the embodiments represented in FIG. 2 or FIGS. 3A through 3C, it is possible to prevent the satellites from adhering to the discharging surface 31 more reliably if a sensor 102 for measuring the temperature, moisture and other elements of the circumferential environment or a sensor 103 for measuring the surface potential of the conveyer belt is added so that the voltage to be applied to the electrode 6 can be automatically set by the signals from the control unit 100 on the basis of the circumferential environment detected by the aforesaid sensor 102 or 103.

Also, the power source used for each of the embodiments is not limited to a direct current source. The structure may be configured to apply a d.c. biased a.c. voltage.

For example,

| | |
|---|---|
| d.c. portion | +700 V |
| a.c. portion | 300 Vp—p, 1kHz |

In the present embodiment, in this respect, the power source for injecting into the recording medium, attracted to and held by the conveying means, the charge of polarity opposite to the polarity of the charge given to the conveying means through the electrode can be a source capable of varying its output voltage.

Also, as described earlier, provision of the sensor 9 for measuring the surface potential of the recording medium makes the operation more efficient.

Furthermore, as described earlier, provision of the sensor 103 for measuring the surface potential of the conveying means makes the operation still more efficient.

Further, as described earlier, provision of the sensor 102 for measuring the elements of the circumferential environment makes the operation still more efficient.

Also, the recording head can be of a full-line type wherein a plurality of discharging ports are arranged over the entire width of the recording area.

Furthermore, the recording head can be of the type which discharges ink from a discharging port by the utilization of thermal energy, and which includes an electrothermal converter as means for generating thermal energy.

Now, in FIG. 3B, a block diagram is shown for each of the aforesaid embodiments to which the present invention is applicable.

In FIG. 3B, a reference numeral 100 designates a control unit which controls the entire systems of the recording apparatus. This control unit 100 is provided with a CPU such as a microprocessor, a ROM for storing the CPU controlling program which will be described in a flowchart shown in FIG. 3C and various data, a RAM used as a working area for the CPU as well as for a tentative storage for various data, and others.

To this control unit 100, the signals from the sensor group 101 for detecting the presence of the recording paper 10, the temperature of the recording head 1 or the like are inputted through an interface portion (not shown). Further, the signals from the surface potential sensor 9 for measuring the surface potential of the recording paper 10, the circumferential environment sensor 102, and the conveying means surface potential sensor 103 are inputted through the aforesaid interface.

Also, from this control unit 100, various signals are output through an output interface portion (not shown) to perform the operational controls described below.

At first, the power source 8 or 8*a* is controlled to perform on-off switching of the electrode 6.

Also, on-off switching of the electrothermal converters 40 of the recording heads 7 (7Bk, 7*y*, 7*m*, and 7*c*) is performed through a head controller 104. Referring to FIGS. 3B the control unit 100 controls, through the output interface (not shown) the recording paper conveying system (for example, the carrier rollers 114*a* and 114*b*, pick up roller 115, resisting roller 13, conveyer belt 1, and discharge rollers 123*a* and 123*b*, and others), the fixing system (heater 124*a* and fan 124*b*), capping unit 126, and head unit 121, to effect a head recovery operation 105 such as ink circulation, head suction and compression by driving pump, and others.

Now, using FIG. 3C, the flowchart of the aforesaid embodiment will be described.

At first, the starting button (not shown) is depressed at the step S1 to begin the copying operation. Subsequently, at the step S2, the head 7 (7Bk, 7*y*, 7*m*, and 7*c*) is initialized at the home position. For example, by driving the pump, the ink circulation, head suction or compression, or the like required for the recovery operation is performed. In this respect, these recovery operations are also appropriately performed in the course of a recording process. Then, at the step S3, the head 7 is brought into a standby state at the standby position for recording. On the other hand, at the step S4, the feeding of the recording paper 10 is started. Then, at the step S5, the rotation of the belt 1 in the direction indicated by arrow A is started, and the charging by the charging roller 4 to the belt 1 is also started with the high-voltage power source 5 turned on simultaneously. Subsequently, at the step S6, when the arrival of the recording paper 10 at a predetermined position is detected by the signals from the sensor group 101, the d.c. power source 8 (8*a*) is energized to injet the charge into the recording paper 10 through the electrode 6. Then, at the step S7, the recording begins, and on-off switching of the electrothermal converter 40 is controlled on the basis of recording information. Then, at the step S8, when the recording on a specific area is terminated, the head 7 is retracted to the home position at the step S9, and a conveying means (not shown) is actuated to perform the capping of the head 7 by the capping unit 126. At the step S10, the d.c. power source 8 (8*a*) is turned off. Subsequently, at the step S11, the driving of the belt 1 is suspended, and the high-voltage power source 5 is also turned off. Thus, the charging by the charging roller 4 is suspended. Then, at the step S12, the copying operation is terminated.

As the above, in each of the aforesaid embodiments, it is possible to prevent the satellites from adhering to the discharging surface of the recording head even if static electricity is utilized for attracting and holding the recording medium. Therefore, according to the present embodiment, ink is normally discharged from the discharging port and a desirable image recording can be performed in a stable condition. As a result, the time required for repairing ink discharging ports, disabled by the adhesion of ink thereto, can be saved.

Also, the conveying velocity of the recording medium can be made faster and there is an effect that a high-speed recording can be implemented.

Further, with embodiment having a power source capable of varying the output voltage, it is possible to set voltage in accordance with the kind of the recording medium or the conveying velocity. Hence, the aforesaid effects can be secured more reliably.

Now, the descriptions will be made of a fourth embodiment through a sixth embodiment according to the present invention.

The embodiment set forth below is structured to provide a control electrode closely to the discharging port, and a voltage is applied to the aforesaid control electrode while the ink droplet is in flight by applying the voltage to the aforesaid control electrode through a control circuit in synchronism with recording signals. Then, with the function described below, the adhesion of the satellites to the vicinity of the discharging port of the discharging surface can be prevented thereby to avoid defects in discharge.

First, in the case where a voltage of the same polarity as that of the surface potential of the recording medium and having an absolute value larger than that of the aforesaid surface potential is applied to the aforesaid electrode while the ink droplet is in flight, the satellite is charged to the same polarity as that of the surface potential of the recording medium. Thus, the satellite repels the aforesaid control electrode by the electric field generated between the aforesaid control electrode and the recording medium. Then, the satellite is attracted by the recording medium to be impacted thereon. Therefore, the adhesion of the satellite to the vicinity of the discharging port of the discharging surface can be avoided.

Also, in the case where a voltage of the same polarity as that of the surface potential of the recording medium having substantially the same value as that of the aforesaid surface potential is applied to the aforesaid electrode while the ink droplet is in flight, practically no electric field is formed. Thus, even if the ink droplet is split into a main droplet and satellites, these droplets are not affected by any electric field and are impacted on the recording medium as they are. Therefore, the adhesion of the satellite to the vicinity of the discharging port of the discharging surface can be prevented.

Further, if a voltage is allowed to be applied to the control electrode with a timing subsequent to the ink droplet in flight having been split into the main droplet and satellites, the voltage to be applied can be a low voltage just effective enough to enable only fine satellite having the same polarity as that of the recording medium to be repelled, thus making it possible to prevent the satellites from adhering to the vicinity of the discharging port of the discharging surface more strictly.

Hereinafter, using the accompanying drawings, the specific description will be made.

Figure 5:
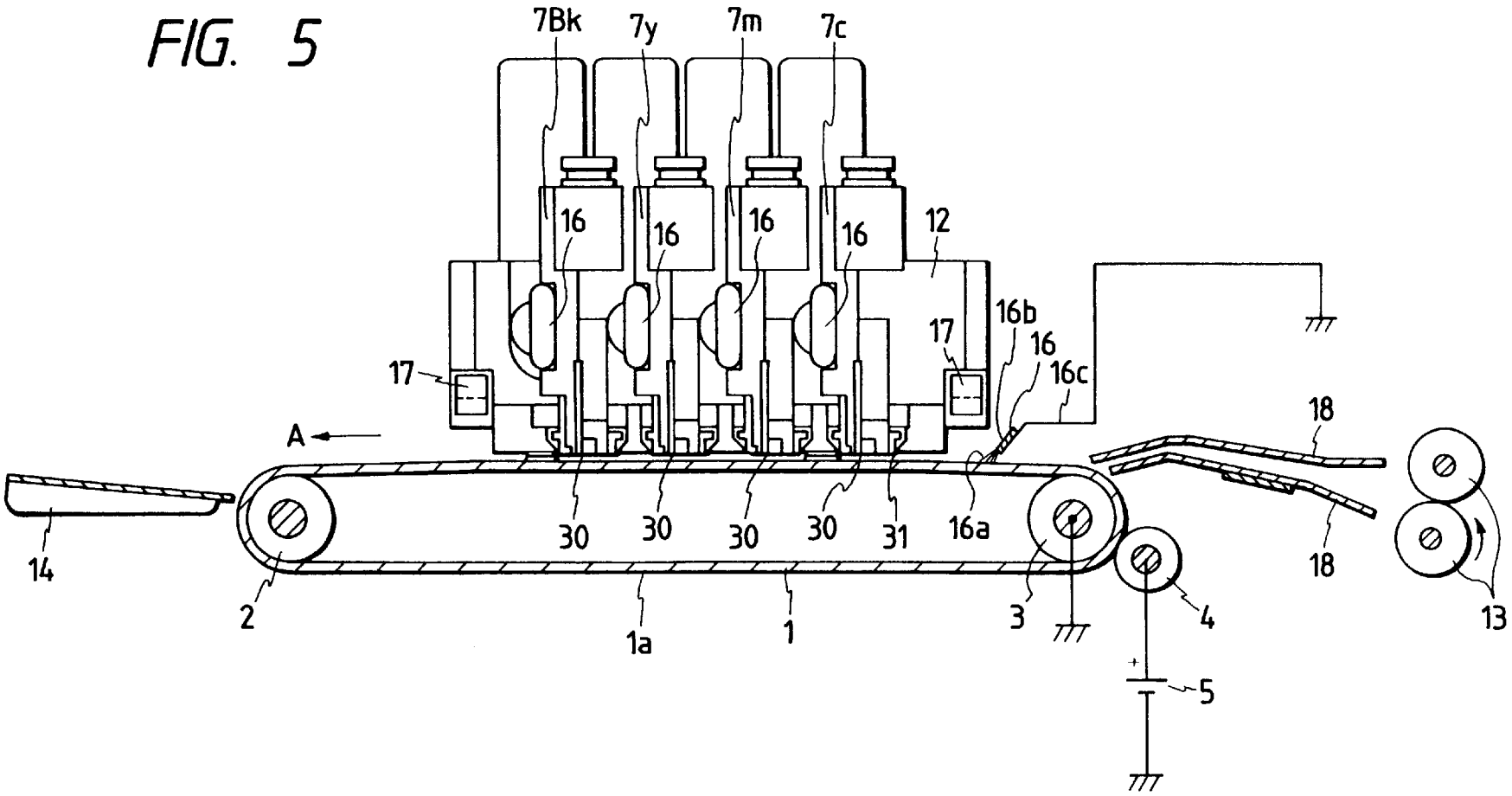
FIG. 5 is a cross-sectional side view schematically showing the structure of a fourth embodiment according to the present invention.
Figure 6A:
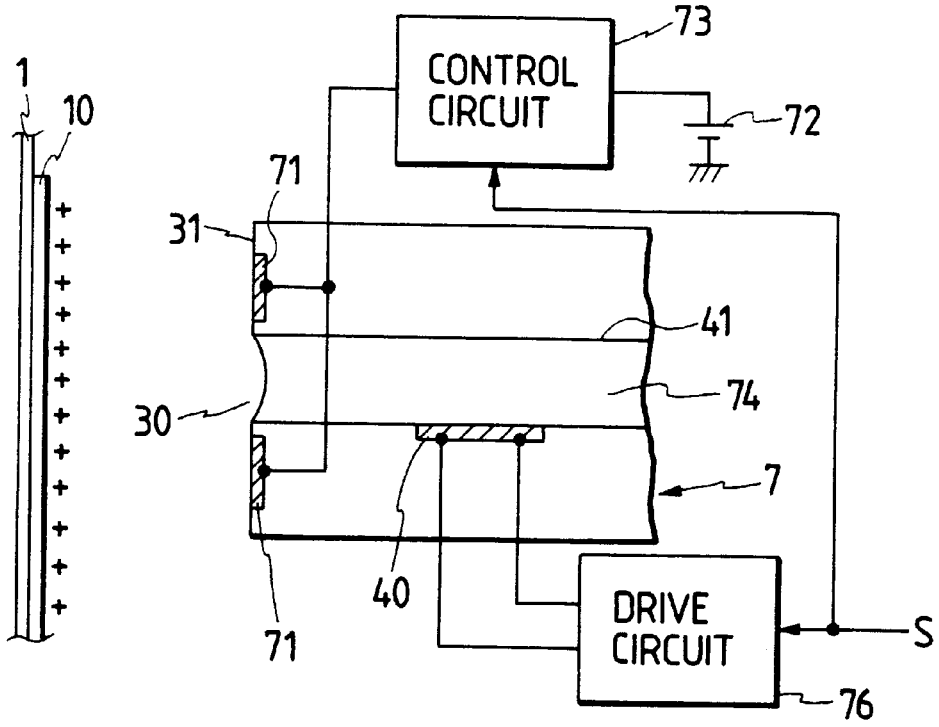
FIG. 6A is a view illustrating the principal part of the recording apparatus shown in FIG. 5.
Figure 7:
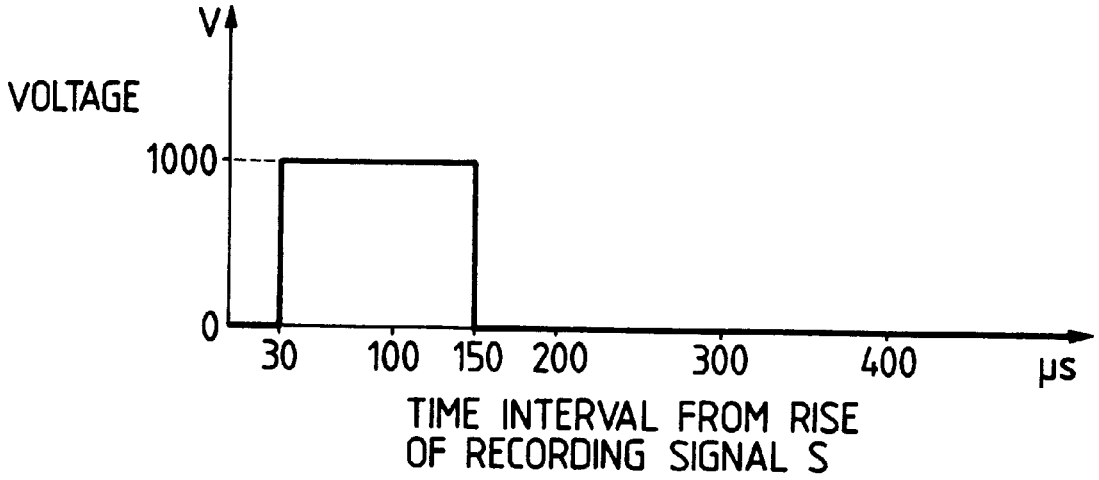
FIG. 7 is a graph showing the waveform of a voltage applied to the control electrode.
Figure 6B:
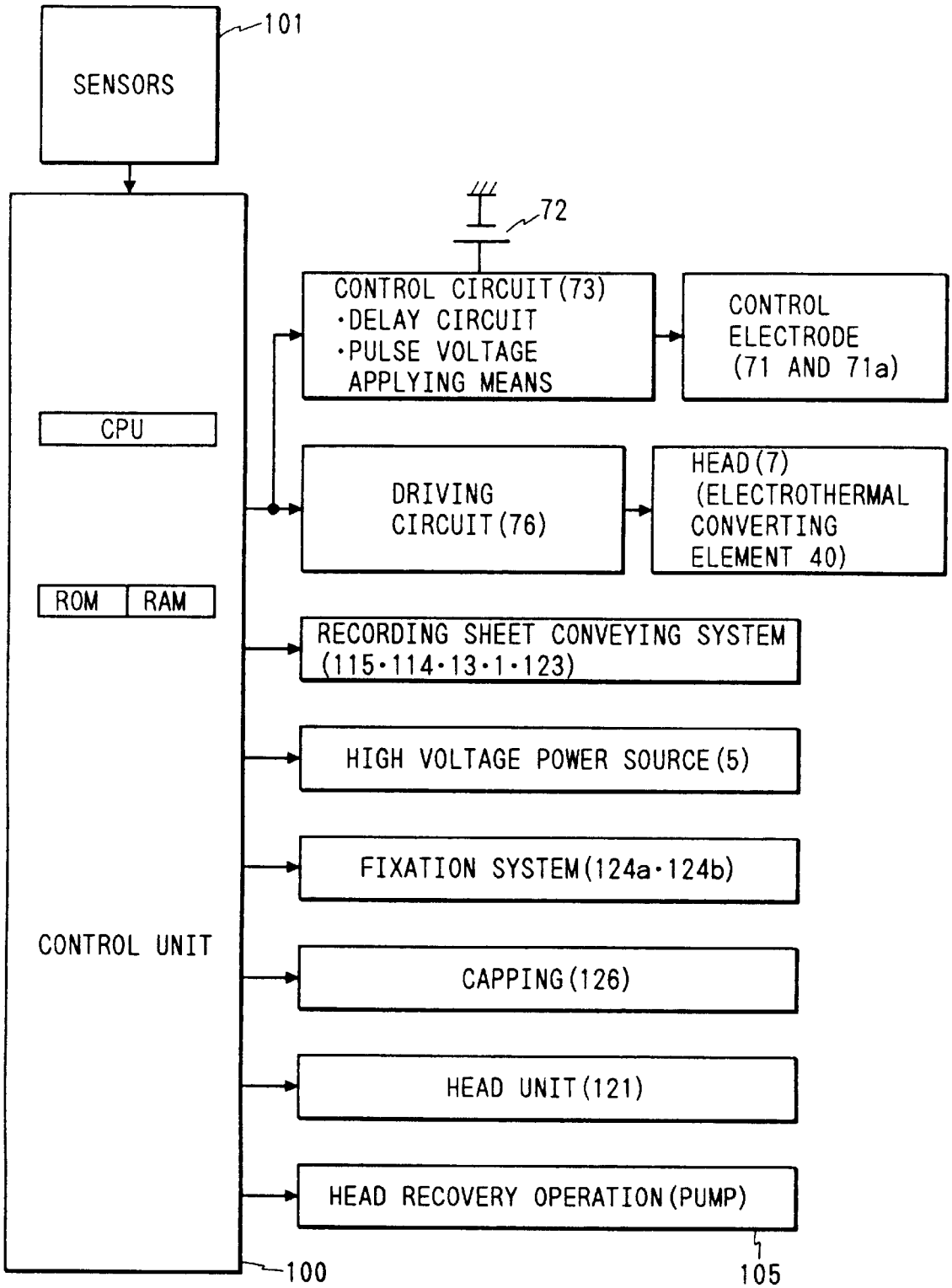
FIG. 6B is the block diagram thereof.
Figure 6C:
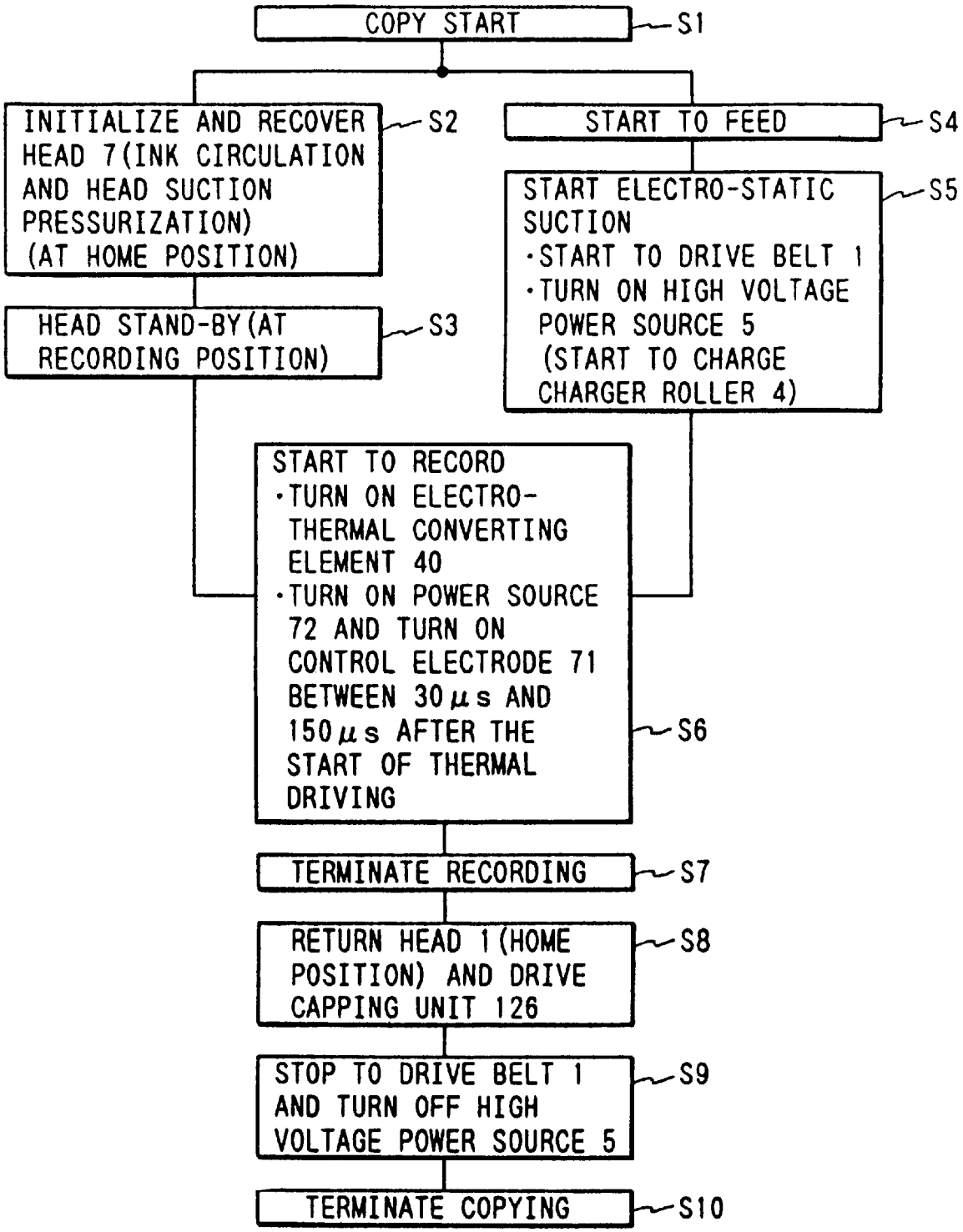
FIG. 6C is the flowchart thereof.
Figure 8A:
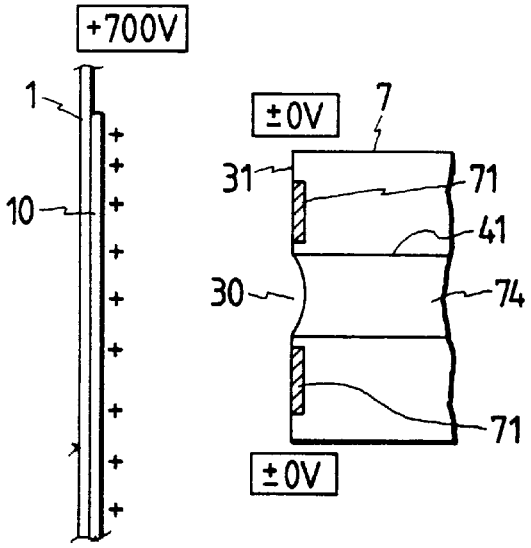
FIGS. 8A and 8B are views respectively illustrating the operation of the recording apparatus shown in FIG. 5.
Figure 8B:
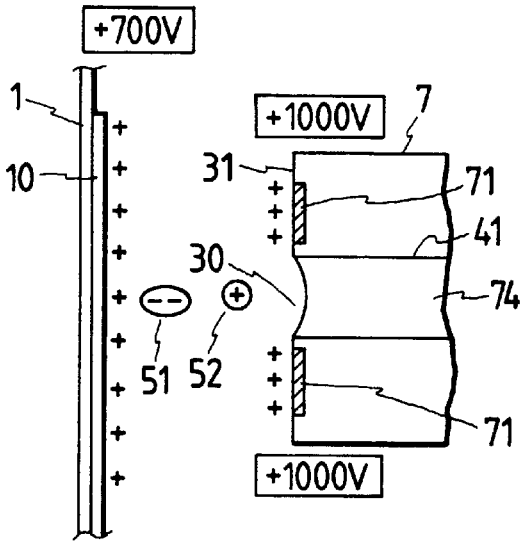

FIG. 5 is a cross-sectional view schematically showing the structure of a fourth embodiment of the ink jet recording apparatus according to the present invention. FIG. 6A is a view illustrating the principal part of the recording apparatus shown in FIG. 5. FIG. 6B is the block diagram thereof, and FIG. 6C is the flowchart thereof. FIG. 7 is graph showing the waveform of the voltage applied to the control electrode 11, and FIGS. 8A and 8B are views respectively illustrating the operation of the recording apparatus according to the present embodiment.

In FIG. 5, in this respect, a reference numeral 16 designates a de-electrifying brush which is a grounded brush type electrode and is provided in the upstream side of the recording position in the conveying direction of the recording medium 10 to be in contact with the surface of the conveyer belt 3.

Further, a reference numeral 16*a* designates a brush portion; 16*b*, a holder fixed on the mounting portion 16*c*. Here, the mounting portion 16*c* is grounded.

Also, the same reference marks are provided for the same members in the aforesaid embodiment and the descriptions thereof will be omitted.

Now, the details of the recording head 7 will be described in conjunction with FIG. 6A.

On the surface (discharging surface 31) of each of the recording heads 7 (7Bk, 7*y*, 7*m*, and 7*c*) facing the conveyer belt 1, many discharging ports 30 are arranged as described above. Further, for each of the discharging ports 30, a torus-type electrode 71 is provided to surround the aforesaid discharging port 30. Each of the control electrodes 71 is connected to a positive power source 72 of +1 kv through the control circuit 73. In the nozzle portion 41 connectively arranged behind the discharging port 30, an electrothermal converter 40 is provided to heat ink 74 in the nozzle 41. The electrothermal converter 40 is driven by the drive circuit 76 which will be described later. Here, in the case where the recording medium 10 is attracted to and held on the conveyer belt 1 by static electricity, the space between the recording head 7 and the recording medium 10 is approximately 0.5 mm–1 mm.

Next, the control circuit 73 and drive circuit 76 will be described.

The recording signal S corresponds to image data, and is supplied both to the control circuit 73 and drive circuit 76. When the recording signal S rises, the drive circuit 76 serves to drive the electrothermal converter 40 immediately. As a result, in the recording apparatus according to the present embodiment, the ink droplet leaves the discharging port 30 completely after 30 $\mu$s subsequent to the aforesaid signal rise and begins to fly. Then after 100 $\mu$s from the aforesaid rise, the ink droplet is impacted on the surface of the recording medium 10. On the other hand, the control circuit 73 serves to apply the voltage from the power source 72 to the control electrode 71 during the period from 30 $\mu$s to 150 $\mu$s subsequent to the rise of the recording signal S, through a delay circuit and pulse voltage application means, but not during any other periods than this duration. Therefore, the voltage applied to the control electrode 71 changes as shown in FIG. 7 where the rise of the recording signal S is 0 $\mu$s because the voltage of the power source 72 is +1 kv.

Subsequently, the operation of the present embodiment will be described.

At first, using FIG. 5, the recording operation will be described.

To the charging roller 4, a voltage of approximately +1.5 kv is applied from the high-voltage power source 5. Thus, the surface of the conveyer belt 1 is positively charged. When the recording operation is started, the recording medium 10 is drawn by the pair of resisting rollers 13 to be fed onto the conveyer belt 1. Then, when the recording medium 10 is in contact with the conveyer belt 1, the lower side (the side facing the conveyer belt) of the recording medium 10 is charged negatively due to the dielectric polarization because the surface of the conveyer belt 1 is positively charged. Thus the recording medium 10 is attracted to the conveyer belt 1. The conveyer belt 1 is driven to convey the recording medium 10 in the direction indicated by arrow A. Then, the surface of the recording medium 10 is in contact with the de-electrifying brush 16 to neutralize the positive charge given to the surface thereof by the dielectric polarization. In this way, the recording medium 10 is more intensively attracted to the conveyer belt 1. At this juncture, the surface potential of the recording medium is approximately +700 to +800V. When the recording medium 10 has reached underneath the recording head 7, the recording is performed by discharging ink, and the recorded recording medium 10 is output onto the stocker 14.

Subsequently, the further description will be made of the operation just before and after the ink discharging in detail in conjunction with FIG. 6 and FIGS. 8A and 8B.

In the initial state, no voltage is applied to the control electrode 71 by the aforesaid control circuit 73. Accordingly, an electric field is formed toward the recording head 7 from the recording medium 10 (FIG. 8A).

Here, when the recording signal S rises, the driving circuit 76 drives the electrothermal converter 40 immediately to heat a part of ink 74 in the nozzle 41 by the electrothermal converter 40 to allow the ink to foam. By this foaming, the ink droplet is discharged from the discharging port 30 to begin flying toward the recording medium 10. Soon the ink droplet is split into the main droplet having relatively large volume and velocity and the satellite (sub-droplet) having relatively small volume and velocity. The main droplet flys toward the recording medium 10 ahead of the satellite as compared therewith. As described above, there is an electric field toward the recording head 7 from the recording medium 10. Consequently, the main droplet is charged negatively while the satellite, positively.

After 30 $\mu$s subsequent to the rise of the recording signal S (the timing in which the ink droplet leaves the discharging port 30 completely), the voltage of +1 kv of the power source 72 is applied to each of the control eletrodes 71 by the control circuit 73. As this voltage is higher than the surface potential of the recording medium 10, an electric field is formed toward the recording medium 10 from the recording head 7 this time. At this time, the satellite 52 is attracted to the recording medium 10 by this electric field and to be impact thereon. On the other hand, the negatively charged main droplet 51, having the large volume (i.e., mass) and velocity is scarcely affected by this electric field because of its large inertia and is impacted on the recording medium 10 (FIG. 8B).

In 100 $\mu$s subsequent to the rise of the recording signal S, the main droplet of the ink droplet is impacted on the recording medium 10. Also, the satellite, which is still in flight at that time, is impacted on the recording medium 10 in 150 $\mu$s subsequent to the rise of the recording signal S because of the aforesaid electric field toward the surface of the recording medium 10 from the recording head 7.

After 150 $\mu$s subsequent to the rise of the recording signal S, no voltage is applied to any one of the control electrodes 71 by the function of the control circuit 73 (FIG. 6A). Therefore, in waiting for the recovery of the ink 74 in the nozzle 41 in this state as it is, the abovementioned operation can be repeated. In this example, the operation can be repeated at the shortest intervals of 500 $\mu$s.

Thus, in the present embodiment, the satellite is impacted on the recording medium 10 by applying a voltage higher than the surface potential of the recording medium to the control electrodes 71 surrounding the discharging port 30 while the ink droplet is in flight toward the recording medium 10 having the positively charged surface thereof. As a result, it is possible to prevent the satellite from adhering to the discharging surface 31 in the vicinity of the discharging port 30, thus avoiding defective ink discharging.

The aforesaid description is of the case where the surface potential of the recording medium 10 is positive. The present invention is of course applicable to the case where the surface potential of the recording medium 10 is negative. In such a case, the power source 72 should be negative. However, it is necessary to make the absolute value of the voltage of power source 72 greater in comparing the respective absolute values of the surface potential of the recording medium 10 and the voltage of the power source 72.

Now, in FIG. 6B, the block diagram of the aforesaid embodiment is shown.

What differs practically from the block diagram shown in FIG. 3B is that the on-off control of the control electrodes 71 and 71*a* is performed by the signals from the control unit 100 through the control circuit 73.

Subsequently, the flowchart of the aforesaid embodiment will be shown in FIG. 6C.

Figure 3C:
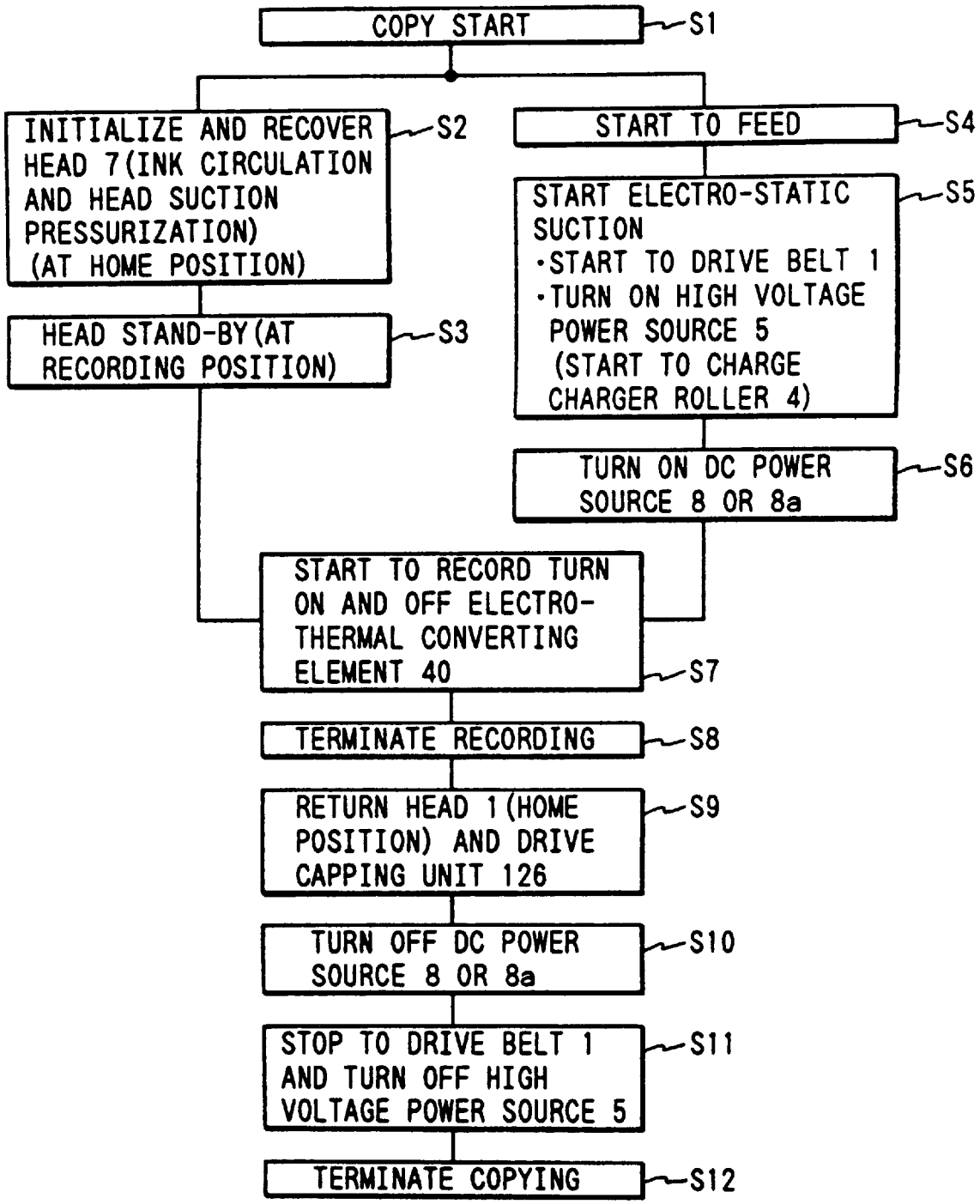
FIG. 3C is the flowchart thereof.

What differs practically from the flowchart shown in FIG. 3C is that at the step S6 in the present embodiment, the control electrodes 71 (71*a*) (the control electrodes 71 (71*a*) provided in the circumference of the discharging port performing the discharging by the thermal driving of the electrothermal converter 40), which function with respect to the thermal driving of the electrothermal converter 40 on the basis of the recording signal S from the control unit 100, control the thermal driving after approximately 30 $\mu$s subsequent to the starting of the thermal driving by the electrothermal converter 40, hold the thermal driving in approximately 150 $\mu$s subsequent thereto, and turn off the thermal driving thereafter. As described earlier, in the present embodiment, the control electrodes 71 provided in the circumference of the discharging port 30 of the nozzle 41 which is not thermally driven by the electrothermal converter 40 do not perform any thermal driving.

Next, a fifth embodiment of the present invention will be described.

In the aforesaid fourth embodiment, the voltage is applied to the electrodes 71 through the delay circuit and pulse voltage application means at a timing (after 30 $\mu$s subsequent to the rise of the recording signal S) at which the ink droplet has completely left the discharging port 30. However, with this timing, there is a possiblity that the droplet has not been yet split into a main droplet and satellite. If the voltage is applied to the control electrodes 71 before the splitting of the ink droplet into a main droplet and satellite, the polarities of the charges given to the main doplet and satellite become opposite to those described earlier so that there is a possibility that the satellite adheres to the vicinity of the discharging port 30 of the discharging surface 31. Therefore, in the fifth embodiment, the timing for the voltage application to each of the electrodes 71 is delayed.

In the recording apparatus according to the aforesaid fourth embodiment, the ink droplet in flight is split into the main droplet and satellite completely after 50 μs subsequent to the rise of the recording signal S. Here in the fifth embodiment, it is desirable to apply the voltage to each of the control electrodes 71 in the period from 50 μs after the rise of the recording signal S to 150 μs thereafter, thereby making it possible to prevent satellites from adhering to the vicinity of the discharging port of the discharging surface.

Next, a sixth embodiment of the present invention will be described.

Figure 9:
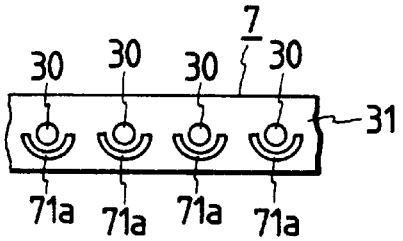
FIG. 9 is a front view of the recording head of a sixth embodiment according to the present invention.

In the aforesaid fourth and fifth embodiments, the control electrodes 71 surrounding the discharging port 30 are of torus type, and the absolute value of the voltage applied to the control electrodes 71 is greater than that of the surface potential of the recording medium 10, but the present invention is not limited thereto. FIG. 9 is a front view showing the recording head 7 in the sixth embodiment.

In this embodiment head 7, many discharging ports 30 are aligned in a line the same as the aforesaid recording head 7. In each of the discharging ports 30, a semi-circular electrode 71*a* is provided at each respective discharging port 30 to surround the lower half portion the discharging port 30. To each of the electrodes 71*a,* the application of voltage from the power source 72 is applied through the control circuit 73 as in the case of the aforesaid embodiment, in synchronism with the flying timing of the ink droplet. However, the voltage of the power source 72 is substantially the same as the surface potential of the recording medium 10.

In this way, there is almost no potential difference between the recording medium 10 and the recording head 7 while the ink droplet is flying, and no electric field is formed. Therefore, even if the ink droplet is split into the main droplet and satellite, these are impacted on the recording medium 10 as they are without being affected by the electric field. As a result, the satellite does not adhere to the vicinity of the discharging port 30 of the discharging face 31, thereby avoiding defective ink discharging.

In the present invention, in this respect, the control electrode is not limited to the torus or semi-circular type. Any type may be applicable as long as the electric field between the recording medium and recording head can be practically controlled. Also, the timing with which the voltage is applied to the control electrode may be defined in any way in accordance with the timing of the flying ink droplet which may vary by the structure of the recording head or the space between the recording head and recording medium.

In the aforesaid embodiment as set forth above, the control electrode is provided close to the discharging port, and the voltage of the same polarity as that of the surface potential of the recording medium, the absolute value of which is substantially equal to or greater than that of the aforesaid surface potential, is applied to the control electrode in synchronism with the recording signal, so that the voltage is applied to the control electrode while the ink droplet is in flight. Hence, either the ink droplet in flight is not affected by any electric field or the satellite is caused to repel the control electrode to be impacted on the recording medium. In this way, the adhesion of the satellite to the vicinity of the discharging port of the discharging surface can be prevented without any water splashing treatment, and there is an effect to avoid defective ink discharging. Further, the voltage is applied subsequent to the timing at which the ink droplet has been split into the main droplet and satellite thereby making it possible to more effectively prevent the satellite from adhering to the discharging surface in the vicinity of the discharging port of and avoid defective ink discharging more reliably.

Further, a seventh embodiment of the present invention will be described.

The embodiment set forth below enables static electricity to be generated by an electric field which is intensified sufficiently to attract and hold the recording medium by a sufficient static electricity in conveying the recording medium. Hence, with the present embodiment, it is possible to perform a stable conveyance. On the other hand, the aforesaid static electricity is weakened while the ink droplet is in flight, so that even if the ink droplet is split into the main droplet and satellite, these are not affected by the electric field eventually and are impacted on the recording medium as they are. Therefore, the adhesion of the satellite to the vicinity of the discharging port of the discharging surface can be prevented.

Figure 10:
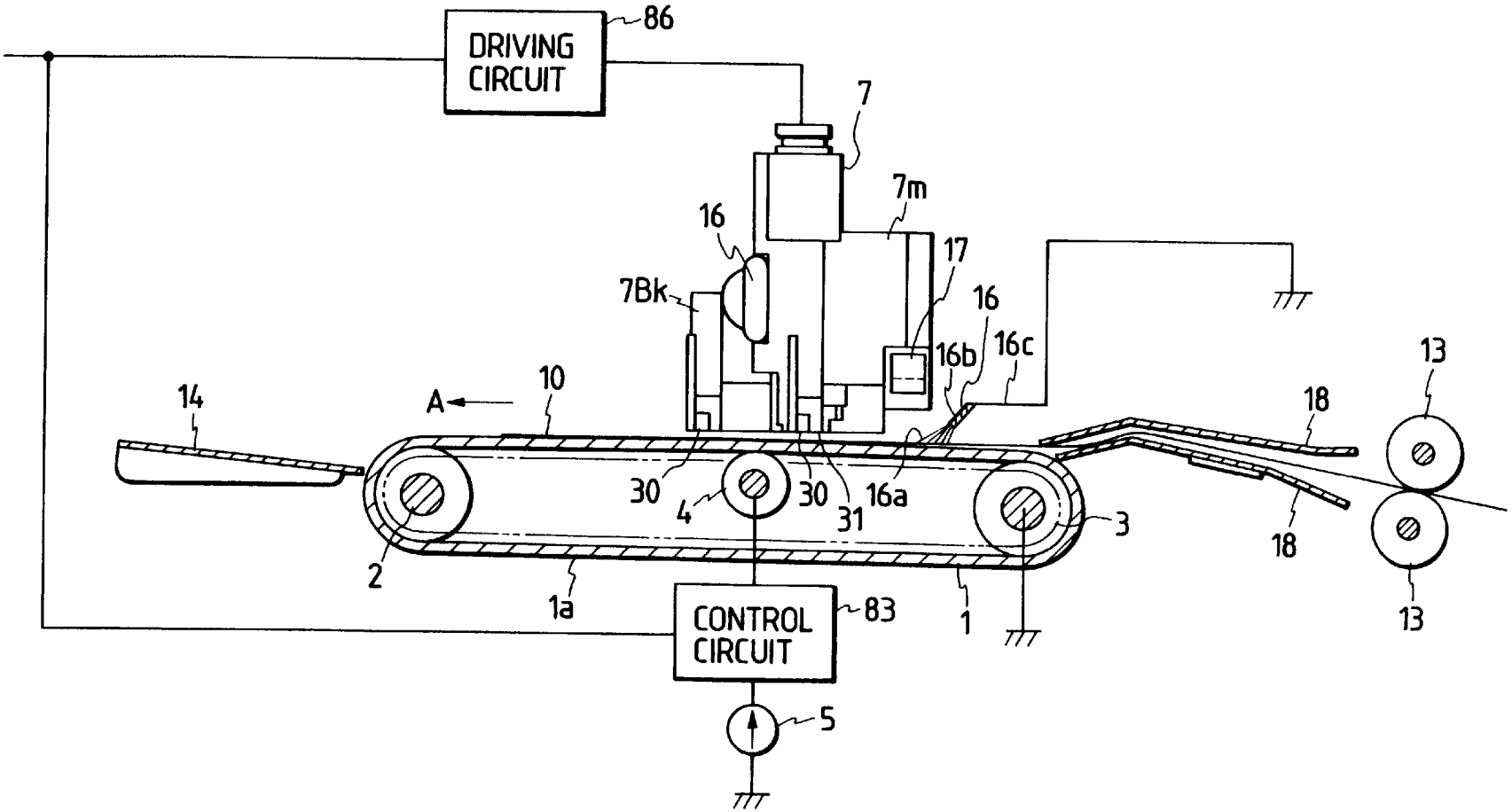
FIG. 10 is a cross-sectional side view showing the structure of a seventh embodiment according to the present invention.

FIG. 10 is a cross-sectional side view showing the seventh embodiment of the ink jet recording apparatus to which the present invention is applicable. What differs from the aforesaid embodiment is that the charging roller 4, which charges the conveyer belt 1, is positioned substantially in the center of the rollers 2 and 3, and the recording heads are configured with two heads (7Bk and 7*m*) for colors, black and magenta. In other words, the charging roller 5 is in contact with the reverse side of the conveyer belt 1 substantially in the center in the conveying direction of the recording medium 10. The aforesaid charging roller 5 is made of a dielectric material, to which a voltage of approximately) +1,500 V is applied from a high-voltage power source 5 through the control electrode 83 which will be described later. Further, the de-electrifying brush 16 which is a grounded brush type electrode is provided at an upstream side of the recording position to be in contact with the surface of the conveyer belt 1.

Now, the description will be made of the control circuit 83 and driving circuit 86 to which the present embodiment is applicable, with reference to FIGS. 11A–11C.

The recording signal S is a signal with a pulse width of 20 μs capable of responding to all image data to be recorded, and is supplied both to the control circuit 83 and driving circuit 86 every 500 μs. As shown in FIG. 11A, when the recording signal S rises, the driving circuit 86 causes the electrothermal converter 40 to be thermally driven immediately. As a result, in the recording apparatus according to the present embodiment, the ink droplet leaves the discharging port 30 completely to begin flying after 30 μs to 40 μs subsequent to the aforesaid rise of the recording signal provided that there is no electric field between the recording medium 10 and recording head 7. Then, after 100 μs to 150 μs subsequent to the aforesaid rise, the ink droplet is impacted on the surface of the recording medium 10 (the space between the discharging port 30 and recording medium 10 is approximately 0.3 mm–1.0 mm). On the other hand, the control circuit 83 does not allow the voltage of the high-voltage power source 5 to be applied to the charging roller 4 between the rise of the recording signal S and 150 μs thereafter (makes it zero), but allow the voltage to be applied in the periods other than this duration. Therefore, as the voltage of the high-voltage power source 5 is +1,500 V, the change in the voltage applied to the charging roller 4 is the voltage $V_1$ of the charging roller 4 as shown in FIG. 11B provided that the rise of the recording signal S is 0 μs. In other words, the voltage of the charging roller 4 is zero V at the time of the rise of the recording signal S and is kept zero until approximately 150 μs thereafter. Then, the voltage becomes 1,500 V until the next recording signal S rises.

Subsequently, the operation of the present embodiment will be described.

At first, the recording operation will be described.

To the charging roller 4, as described earlier, the voltage of approximately +1,500 V is applied from the high-voltage power source 5 through the control circuit 83 to charge the surface of the conveyer belt 1 positively. When the recording operation is started, the recording medium 10 is fed onto the conveyer belt 1 by the pair of the resisting rollers 13. Then, when the recording medium 10 is in contact with the conveyer belt 1, the negative (−) charge is given to the lower side of the recording medium 10 (the side facing the conveyer belt 1) by the dielectric polarization because the conveyer belt 1 is positively (+) charged. Accordingly, the recording medium 10 is attracted to the conveyer belt 1. When the conveyer belt 1 is driven to convey the recording medium 10 in the direction indicated by arrow A in FIG. 10, the surface of the recording medium 10 is in contact with the de-electrifying brush 16 to enable the positive (+) charge given to the surface to be neutralized. Thus, the recording medium 10 is more intensely attracted to the conveyer belt 1. At this juncture, the surface potential of the recording medium 10 is approximately +700–+800 V. When the recording medium 10 has reached beneath the recording head 7, the recording is performed by discharging ink, and the recorded recording medium 10 is output onto the stocker 14.

Next, the operation just before and after ink discharging will be described in detail.

In the initial state, the voltage $V_1$ of +1,500 V is applied to the charging roller 4 by the function of the above-mentioned control circuit 83. Hence, the electric field toward the recording head 7 from the recording medium 10 is formed.

Here, when the recording signal S rises, the driving circuit 86 causes the electrothermal converter 40 to be driven immediately to heat a part of ink in the nozzle 41 by the electrothermal converter 40 to foam. By this foaming, the ink droplet is discharged from the discharging port 30 to begin flying toward the recording medium 10. Soon the ink droplet is splitted into the main droplet having a relatively large volume and velocity and the satellite (sub-droplet) having a relatively small volume and velocity. The main droplet flies ahead toward the recording medium 10 as compared with the satellite. As described earlier, there is an electric field directed toward the recording head 7 from the recording medium 10 thereby to charge the main droplet negatively (−) and satellite, positively (+).

When the recording signal S rises, the application of the voltage $V_1$ of +1,500 V to the charging roller 4 from the high-voltage power source 5 is suspended by the function of the control circuit 83 (the voltage $V_1$ becomes zero). Consequently, the electric field between the recording medium 10 and the recording head 7 is eliminated. After 100 $\mu$s subsequent to the rise of the recording signal S the main droplet of the ink droplet flies at a high speed to be impacted on the recording medium 10. The satellite which is still floating in the air then is also impacted on the recording medium 10 by a timing 150 $\mu$s subsequent to the rise of the recording signal S at the latest because there is no electric field between the aforesaid recording medium 10 and the recording head 7.

After 150 $\mu$s subsequent to the rise of the recording signal S, the voltage $V_1$ of +1,500 V is again applied to the charging roller 4 by the function of the control circuit 83. In waiting for the recovery of ink in the nozzle 41 in this state as it is, it becomes possible to repeat the above-mentioned operation. In the case of this example, the operation can be repeated at the shortest intervals of 500 $\mu$s.

Thus, in the present embodiment, the application of the voltage $V_1$ to the charging roller 4 is suspended in the timing during which the ink droplet flies toward the recording medium 10 having the positive (+) surface potential to eliminate the electric field between the recording medium 10 and the recording head 7, and the satellite is allowed to impact on the recording medium 10. As a result, the adhesion of the satellite to the discharging surface 31 in the vicinity of the discharging port 30 is prevented, thus avoiding defective ink discharging.

The aforesaid description has been made of the case where the surface potential of the recording medium 10 is charged positively (+). The present invention is of course applicable to the case where the surface potential of the recording medium 10 is charged negatively (−).

Figures 11A, 11B, 11C:
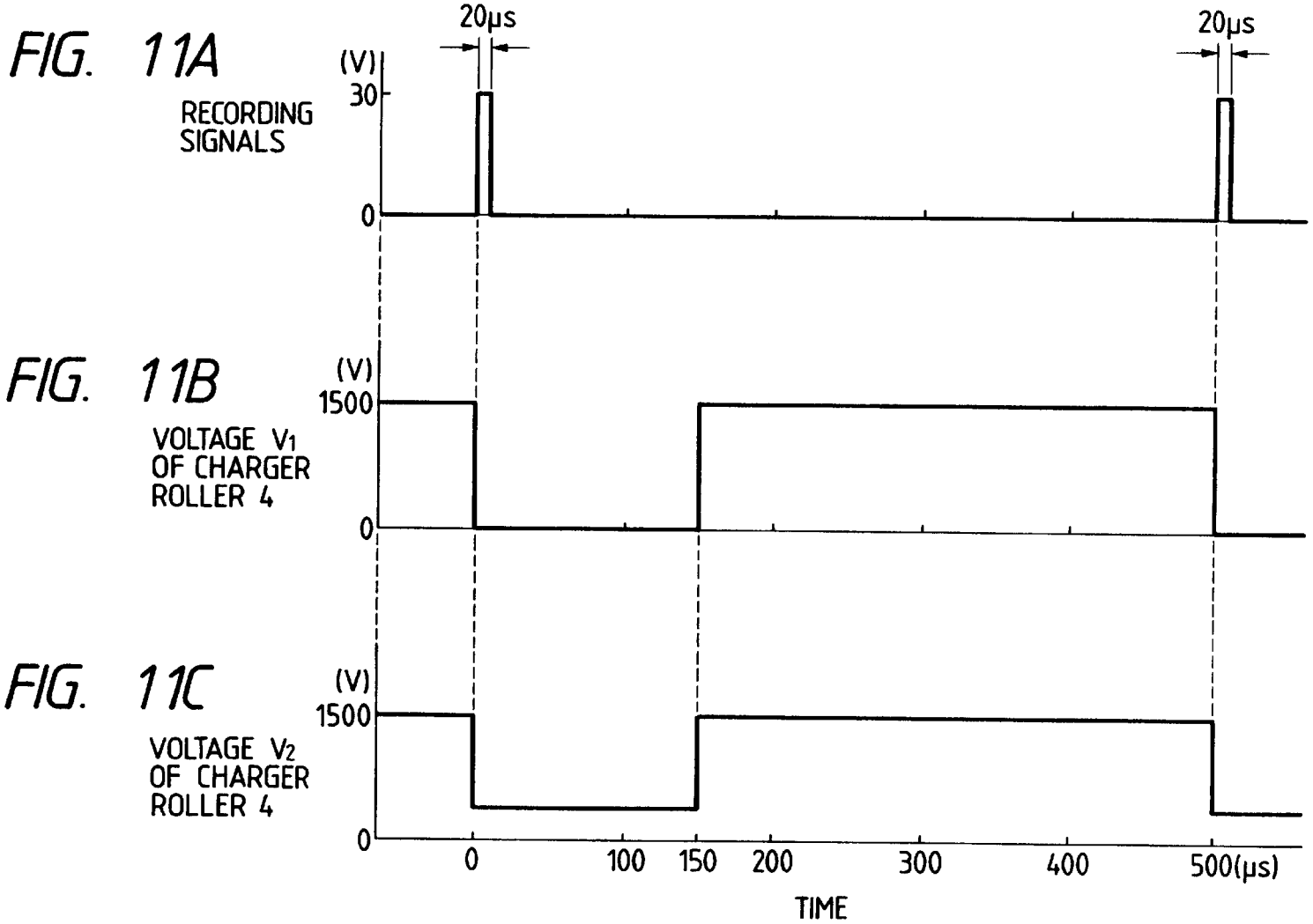
FIGS. 11A through 11C are the time charts showing two examples of voltage applied to the recording signal and charging roller.

As shown in FIG. 11B, the voltage $V_1$ of the charging roller 4 is zero while the ink droplet is flying in the present embodiment, but it is not necessary to make the voltage strictly zero. As illustrated by the voltage $V_2$ of the charging roller 4 shown in FIG. 11C, the voltage may be reduced for the same purpose to approximately 200 V or less at which the satellite is not caused to be drawn back toward the recording head 7. Also, in this case, the electric field between the recording medium 10 and the recording head 7 is 600 V/0.7 mm or less, and a desirable result is obtainable. In the present embodiment, the electric field generating the static electricity while ink is in flight should be 600 V/0.7 mm or less.

Also, the power source used for the present embodiment is not limited to direct current only. The structure may be arranged so that a voltage of direct current overlapped with alternating current may be applicable.

For example, the structure may be:

| | |
|---|---|
| d.c.portion | +700 V |
| a.c.portion | 300 $V_{p-p}$, 1 kHz |

According to the aforesaid embodiment, the electric field generating the static electricity is made small while the ink droplet is in flight. In other words, by lowering the voltage to be applied to the charging roller, the flying ink droplet is not affected by the electric field eventually, and is impacted on the recording medium as it is. Hence, there is no adhesion of the satellite to the discharging surface in the vicinity of the discharging port, thereby avoiding defective ink discharging. Therefore, there is an effect that a desirable recording can be performed. Also, using the electrostatic attraction conveyer belt, there is no need for any particular platen to be employed for supporting the conveyer belt on a flat plane, leading to the implementation of the manufacturing cost reduction.

Next, a description will be made of the other embodiment of an ink jet recording apparatus to which each of the aforesaid embodiments are applicable.

Figure 12:
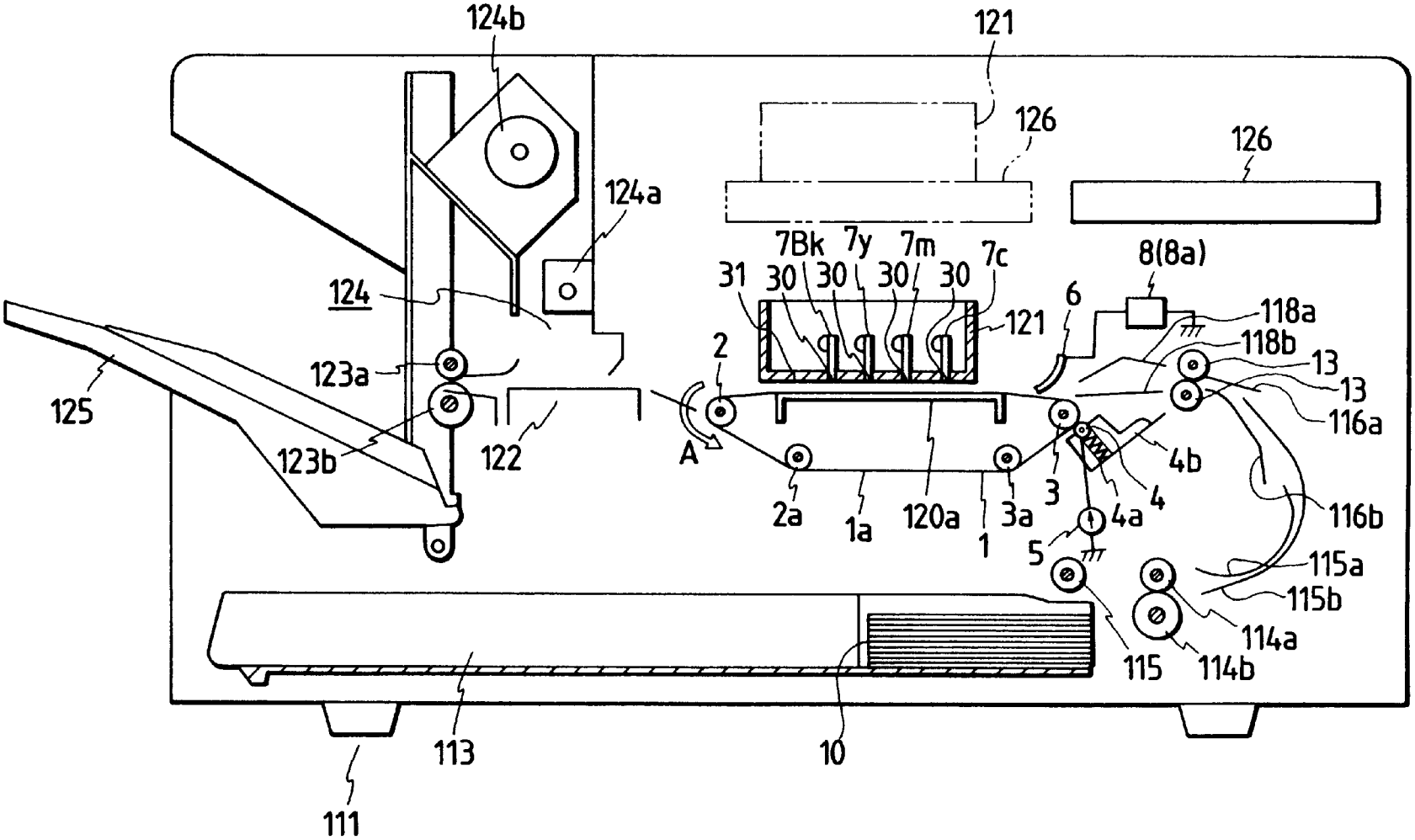
FIG. 12 is a side view schematically showing an ink jet recording apparatus to which each of the aforesaid embodiments is applicable.
Figure 13A:
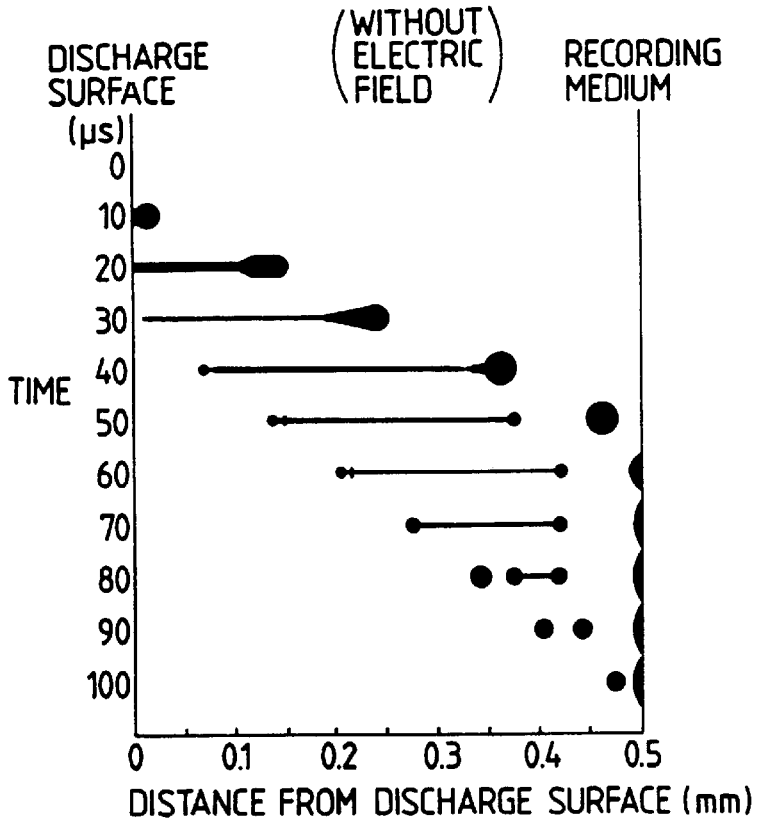
FIG. 13A PRIOR ART
FIGS. 13A and 13B are views illustrating the state of the ink droplets in flight.
Figure 13B:
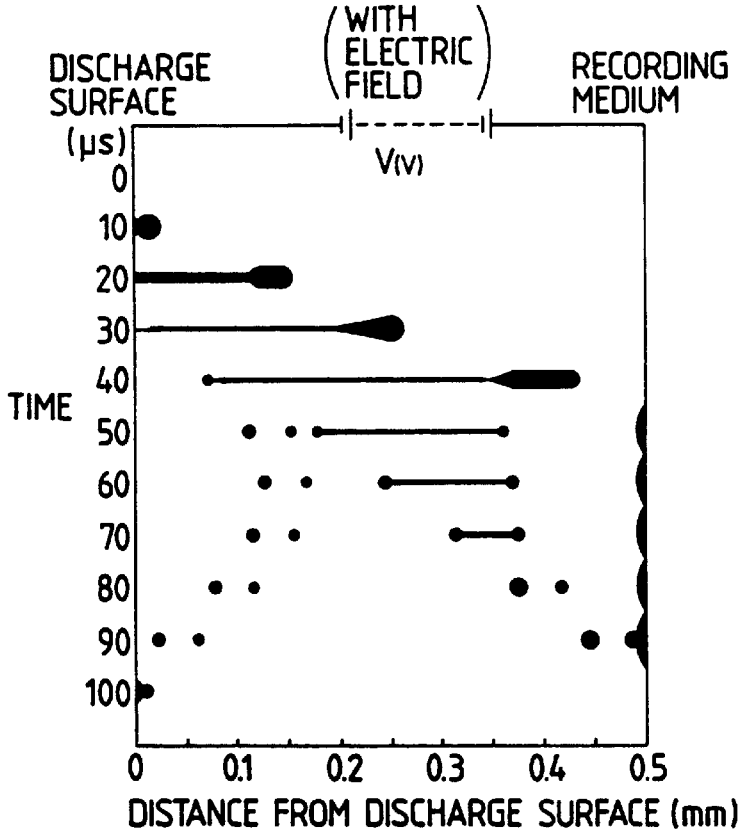
FIG. 13B PRIOR ART
Figure 14:
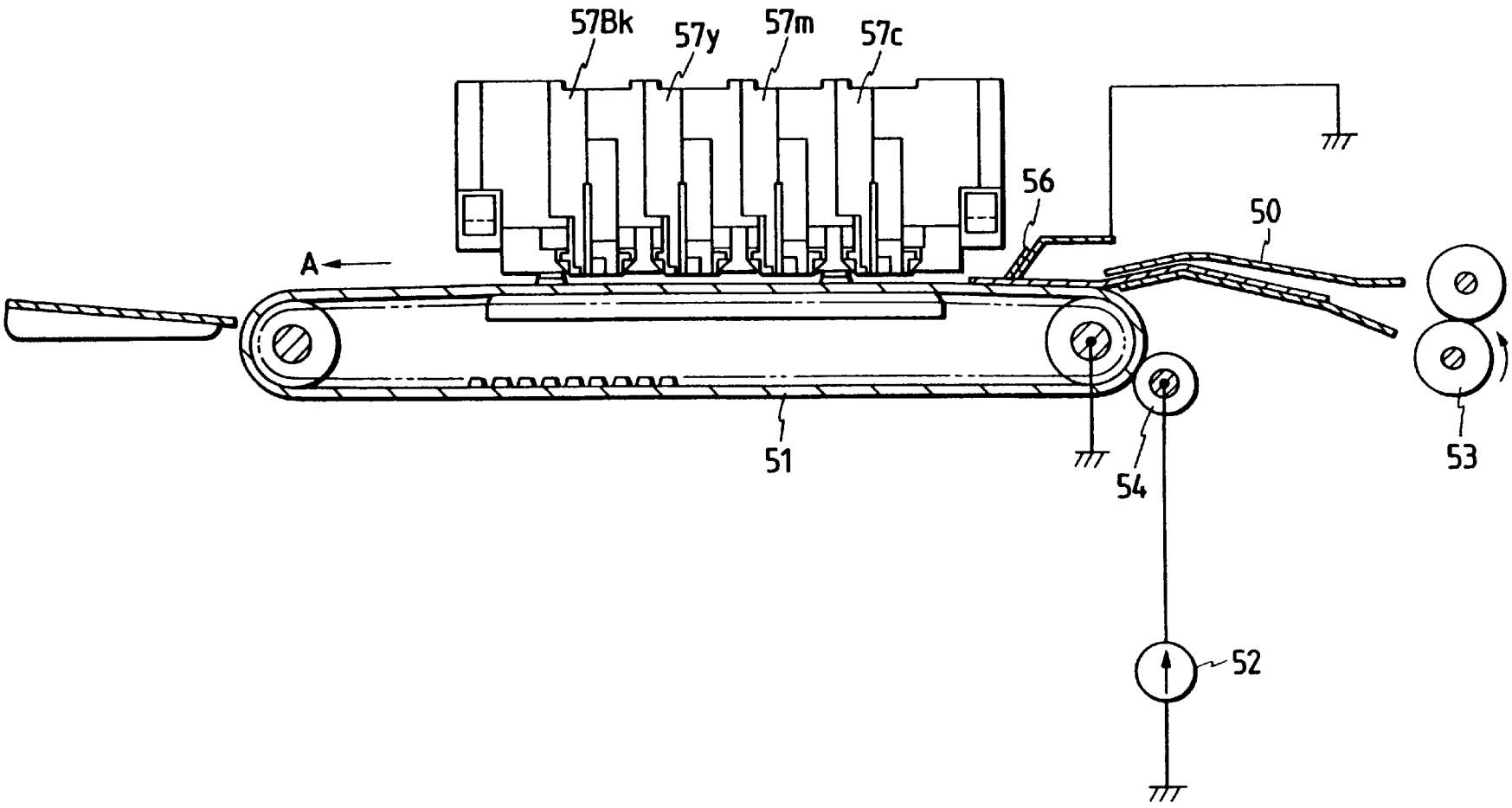
FIG. 14 PRIOR ART
FIG. 14 is a view schematically showing a conventional example.
Figures 15A, 15B, 15C, 15D:
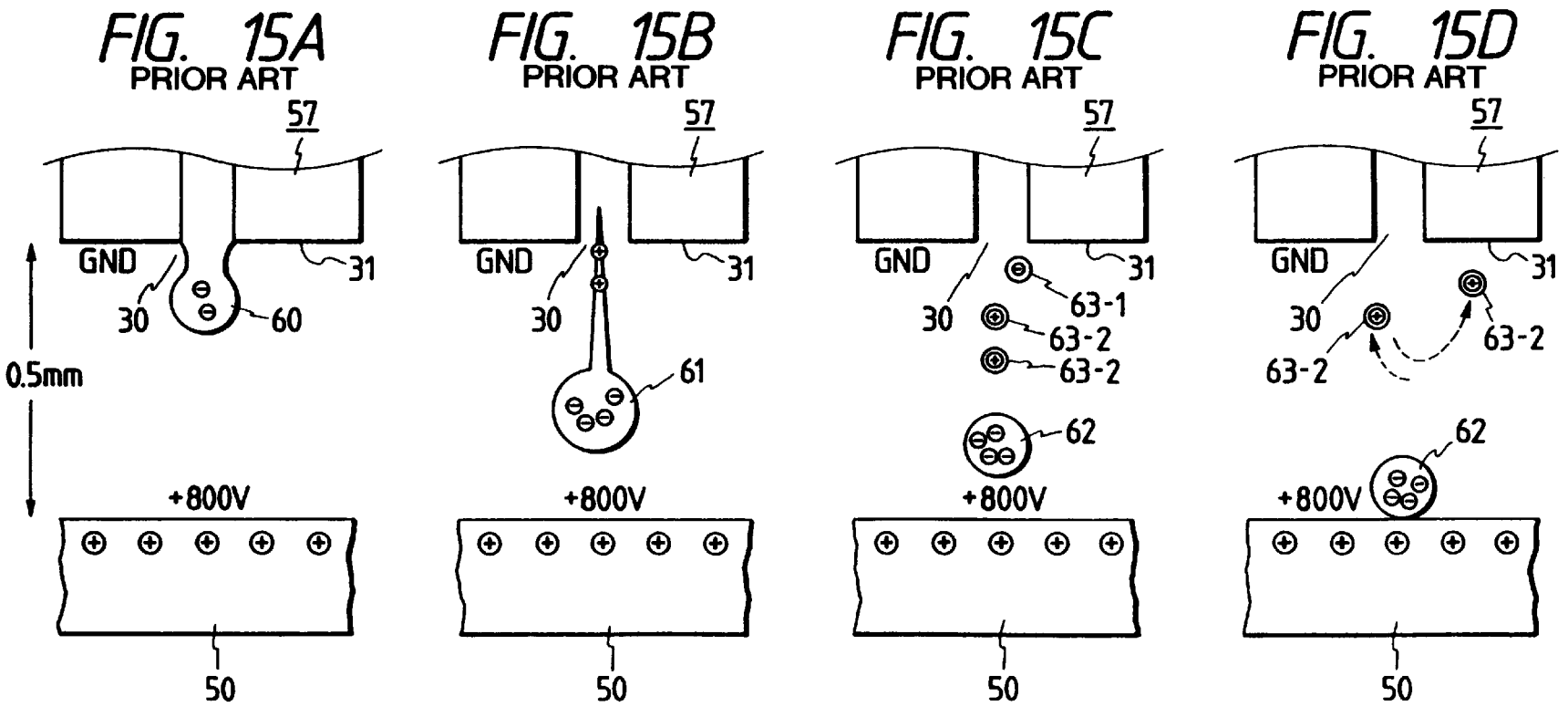
FIG. 15A PRIOR ART
FIG. 15B PRIOR ART
FIG. 15C PRIOR ART
FIG. 15D PRIOR ART
FIGS. 15A through 15D are views illustrating the states of the recording respectively.

FIG. 12 is a cross-sectional side view schematically showing the ink jet recording apparatus to which each of the aforesaid embodiments is applicable. In this respect, there is shown in FIG. 13 an example of the case where the first embodiment or the second embodiment is applicable, but it is needless to mention that the application of the other embodiments is possible. Also, the same reference marks are attached to the same members appearing in the aforesaid embodiments.

In FIG. 12, at the bottom of the ink jet recording apparatus 111, a paper supply cassette 113 is detachably installed to store the recording paper 10, which is a recording medium, cut into a predetermined size.

On the right-hand side of the aforesaid paper supply cassette 113 in FIG. 12, a pair of feed rollers 114*a* and 114*b*, at least one of which is forcibly rotated, are rotatively mounted on a shaft. Then, accompanying the rotation of the aforesaid pair of feed rollers 114*a* and 114*b*, the recording paper 10, forced out one by one by a pick up roller 115 from the paper supply cassette 113, is pinched for feeding. Subsequently, being guided sequentially through two curving guide plates 115*a* and 115*b* and two preresist guide plates 116*a* and 116*b*, the recording paper is conveyed to a pair of resisting rollers 13.

The aforesaid pair of resisting rollers 13 are rotatively mounted respectively, and at least one of them is forcibly rotated. Accompanying the rotation thereof, the aforesaid recording paper 10 is pinched for feeding, and sequentially conveyed and guided through two post resist guide plates 118*a* and 118*b* onto the charged attraction belt 1.

The aforesaid charged attraction belt 1 is stretched around four rollers (2, 2*a*, 3 and 3*a*) each rotatively supported, and at least one of the rollers is forcibly rotated at a predetermined rotational velocity to allow the belt to rotate in the direction indicated by arrow A in FIG. 12. Directly beneath the upper traveling path of the aforesaid charged attraction belt 1 in FIG. 12, a back platen 120*a* is arranged to enable the charged attraction belt 1 running on the aforesaid back platen 120*a* to form a flat surface.

Also, the aforesaid charged attraction belt 1 is charged by a charging roller 4 which is in contact with the charged attraction belt 1 to apply a voltage thereto, and the aforesaid recording paper 10 is attracted thereby with the static electricity to be conveyed to underneath the four recording heads 7Bk, 7*y*, 7*m*, and 7*c*.

Further, an electrode 4 is arranged to be in contact with the surface of the charged attraction belt 1 to inject an electric charge to the recording paper 10.

Now, the aforesaid four recording heads respectively arranged for four different colors, 7Bk, 7*y*, 7*m*, and 7*c* are the full-line type having 4,736 discharging ports 30 with a density of 400 dpi (400 pieces per inch) for each to cover the entire recording area of the recording paper 10, and are installed at equal intervals in a head unit 121 mounted on a known conveying means (not shown).

Each of the discharging ports 30 of the aforesaid respective recording heads 7Bk, 7*y*, 7*m*, and 7*c* is positioned apart from the charged suction belt 1 with a predetermined space therebetween at the time of recording. Also, at the time of non-recording, the recording heads are elevated with the head unit 121 by the aforesaid conveying means (not shown) to a position indicated by a dashed line above the charged suction belt 1 in FIG. 12, and the structure is arranged so that the head discharging port 30 is closed airtight by the capping unit 126 which has also been moved interrelatedly for the purpose.

In the aforesaid capping unit 126, there is provided a means for collecting the waste ink discharged from each of the recording heads 7Bk, 7*y*, 7*m*, and 7*c* and guiding the waste ink to a waste ink tank (not shown) when the head recovering operation is performed at the time of airtight closing, as described above.

Now, on the left-hand side of the aforesaid charged attraction belt 1 in FIG. 12, a plurality of guide plates 122 and a pair of exhausting rollers 123*a* and 123*b* are sequentially arranged in series. Then, the recorded recording paper 10 is output to a tray 125 after passing through the charged attraction belt 1 and a fixing and exhausting portion 124 while, if required, air is being blown from a heated fan 124*b* by a heater 124*a*.

In this respect, the present invention is efficient in producing an excellent effect on the recording head and recording apparatus of the ink jet recording method, particularly the one using the method for performing the ink jet recording by forming flying droplets by the utilization of the thermal energy.

For the typical structure and principle thereof, it is desirable to adopt for its implementation the fundamental principle disclosed, for example, in the specifications of U.S. Pat. No. 4,723,129 and U.S. Pat. No. 4,740,796. This method is applicable to either so-called on demand type and continuance type. Particularly, in the case of the on demand type, at least one driving signal, which gives a recording liquid a rapid temperature rise exceeding nucleate boiling, is applied in response to the recording information provided for the electrothermal converter arranged with respect to a sheet or liquid path holding a recording liquid (ink) thereby causing the electrothermal converter to generate thermal energy. Hence, efficient film boiling is generated on the thermo-active plane of the recording head, resulting in the formation of a bubble in the recording liquid one to one in response to the driving signal. The recording liquid is discharged into the atmosphere through the discharging port by the active force generated in the course of the growth and contraction of this bubble to form at least one droplet. It is more desirable to produce this driving signal in the form of pulses. Then, the growth and contraction of the bubble is appropriately performed instantaneously to implement the discharging of recording liquid (ink) with particularly excellent response. For this pulse type driving signal, the one such as disclosed in the specifications of U.S. Pat. No. 4,463,359 and U.S. Pat. No. 4,345,262 is suitable. in this respect, if the condition disclosed in the specification of U.S. Pat. No. 4,313,124 concerning the invention as regards the temperature rise on the above-mentioned thermo-active plane, it is possible to perform an excellent recording in a better condition.

As the structure of the recording head, the present invention includes a combination of the discharging port, liquid path, electrothermal converter (linear liquid path or rectangular liquid path) such as disclosed in each of the above-mentioned specifications as well as the structure having the thermoactive portion arranged in the bending region using the configuration disclosed in the specifications of U.S. Pat. No. 4,558,333 and U.S. Pat. No. 4,459,600.

Further, as to the full-line type recording head having a length corresponding to the maximum width of the recording medium on which the recording apparatus can perform its recording, there may be a structure to attain such length by combining a plurality of recording heads such as disclosed in the above-mentioned specifications or a structure to attain such length by a single recording head integrally constructed. In either case, the present invention can achieve the above-mentioned effects more efficiently.

In addition, the present invention is effective in using a freely replaceable chip type recording head for which the electrical connection to the main body of the recording apparatus and ink supply become possible when it is installed therein, or a cartridge type recording head having the ink tank integrally provided for the recording head itself.

Also, it is desirable to add a recovery means, preliminarily auxiliary means, and the like provided for the recording head as constituents of the recording apparatus of the present invention because with these constituents, the effect of the present invention becomes more stable. More specifically, these constituents are a capping means for the recording head, cleaning means, compression or suction means, electrothermal converter or thermal element independent thereof or preliminary heating means provided by the combination thereof, and others. Also, it is effective to provide a preliminary discharging mode which performs preliminary discharging besides the recording.

Further, as a recording mode of the recording apparatus, the present invention is extremely effective in a recording apparatus which is provided with the recording head formed integrally or by a combination of a plurality of heads for recoloring with different colors as described in the aforesaid embodiments or at least one or full-color by mixing colors besides a recording mode for one major color such as black.

In the embodiments of the present invention set forth above, the description has been made of ink which is a liquid, it may be possible to use ink which is solid at room temperature or less as long as such ink can be liquified when the signal is given.

Furthermore, the particular type of ink jet recording apparatus to which the present invention is applicable include copying machines in combination with readers, facsimile apparatuses having a transmitter and receiver, or the like, in addition to image output terminals for a computer or other information processing apparatuses.

According to the present invention set forth above in detail, it is possible to provide an ink jet recording apparatus capable of maintaining a desirable recording for a long time.

What is claimed is:

1. An electric field control method for an ink jet recording apparatus having an ink jet recording head for discharging ink toward a recording medium, and a conveying means for attracting said recording medium electrostatically and for conveying the recording medium at least to a position facing said ink jet recording head, said method including the steps of:

conveying said recording medium to a position facing said ink jet recording head while attracting the recording medium to the conveying means by static electricity intensive enough to allow the recording medium to be conveyed, the static electricity being generated by an electric field; and subsequently, at a same time at which ink is in flight after being discharged from said ink jet recording head toward said recording medium, decreasing a strength of the electric field which generates said static electricity.

2. An method according to claim 1, wherein the electric field which generates the static electricity is 600 V/0.7 mm or less while said ink is in flight.

3. An ink jet recording apparatus for performing recording by discharging ink from a discharging port of an ink jet recording head in accordance with a recording signal, the apparatus comprising:

a conveyer belt for conveying a recording medium toward said ink jet recording head, and for attracting said recording medium thereto by static electricity generated in response to an injected charge;

a charging roller, in contact with a side of said conveyer belt opposite a side of said conveyer belt facing said ink jet recording head, for injecting the charge to said conveyer belt in accordance with an applied voltage;

a power source for generating the applied voltage; and a control means for controlling the applied voltage so that an injected charge to said conveyer belt results in sufficiently high static electricity between said conveyer belt and said recording medium for conveyance of said recording medium by said conveyor belt and so that the voltage applied to said charging roller is reduced at least while said ink is in flight from discharge by controlling the voltage generated by said power source in synchronism with the recording signal.

4. An ink jet recording apparatus according to claim 3, wherein said control means is a control circuit provided between said charging roller and said power source.

5. An ink jet recording apparatus according to claim 3, wherein said ink jet recording head is a full-line recording head having a plurality of discharging ports provided over an entire width of a recording area of the recording medium.

6. An ink jet recording method for recording on a recording medium by discharging ink through a discharge port of an ink jet recording head, the recording medium being attracted to a conveying belt by static electricity and being conveyed by the conveying belt, the method comprising the steps of:

attracting the recording medium to said conveying belt by creating a predetermined magnitude of static electricity between the recording medium and the conveying belt;

conveying the recording medium at least to a position opposed to the discharge port of the ink jet recording head by driving the conveying belt after said attracting step; and decreasing the magnitude of the static electricity between the recording medium and the conveying belt at the position opposed to the ink jet recording head from the predetermined magnitude.

7. An ink jet recording apparatus according to claim 6, wherein said ink jet recording head is a full-line recording head having a plurality of discharging ports provided over an entire width of a recording area of the recording medium.

* * * * *